US007318553B2

(12) United States Patent
Thoma

(10) Patent No.: US 7,318,553 B2
(45) Date of Patent: Jan. 15, 2008

(54) APPARATUS AND METHOD FOR HEATING FLUIDS

(76) Inventor: Christian Helmut Thoma, The Court House la Grande Route des Sablons, Grouville (GB) JE3 9FG ( * ) Notice: Subject to any disclaimer, the term of this patent is extended or adjusted under 35 U.S.C. 154(b) by 0 days.

(21) Appl. No.: 10/563,363

(22) PCT Filed: Jul. 2, 2004

(86) PCT No.: PCT/US2004/021499

§ 371 (c)(1),
(2), (4) Date: Mar. 16, 2006

(87) PCT Pub. No.: WO2005/003641

PCT Pub. Date: Jan. 13, 2005

(65) Prior Publication Data

US 2006/0174845 A1 Aug. 10, 2006

(30) Foreign Application Priority Data

Jul. 4, 2003 (GB) ..... 03155769
May 29, 2004 (GB) ..... 04121141

(51) Int. Cl.
*B60H 1/02* (2006.01)

(52) U.S. Cl. ..... 237/12.3 R; 237/12.3 B; 165/41; 165/42; 123/142.5 R

(58) Field of Classification Search ..... 237/12.3 B, 237/12.3 R; 165/41, 42; 123/142.5 R
See application file for complete search history.

(56) References Cited

U.S. PATENT DOCUMENTS 3,731,729 A * 5/1973 Beatenbough et al. ..... 165/204
4,106,472 A * 8/1978 Rusk ..... 123/205
4,493,293 A * 1/1985 Paul et al. ..... 123/41.12
4,779,575 A 10/1988 Perkins
4,974,778 A * 12/1990 Bertling ..... 237/12.3 B
5,683,031 A * 11/1997 Sanger ..... 237/1 R
5,743,467 A * 4/1998 Ban et al. ..... 237/12.3 R
5,829,676 A * 11/1998 Ban et al. ..... 237/12.3 R
5,842,635 A * 12/1998 Okabe et al. ..... 237/12.3 R
5,842,636 A * 12/1998 Moroi et al. ..... 237/12.3 R
5,871,149 A * 2/1999 Moroi et al. ..... 237/12.3 R
5,947,376 A * 9/1999 Moroi et al. ..... 237/12.3 R
5,957,121 A * 9/1999 Suzuki et al. ..... 126/247
5,957,122 A 9/1999 Griggs
5,979,163 A * 11/1999 Hanners et al. ..... 60/571
6,039,007 A * 3/2000 Ban et al. ..... 122/26
6,082,316 A * 7/2000 Ban et al. ..... 123/142.5 R
6,158,665 A * 12/2000 Moroi et al. ..... 237/12.3 R
6,244,232 B1 * 6/2001 Ban et al. ..... 123/142.5 R
6,308,896 B1 * 10/2001 Moroi et al. ..... 237/12.3 R
6,325,298 B1 * 12/2001 Hielm ..... 237/12.3 R
6,489,598 B1 * 12/2002 Hielm ..... 219/631
6,595,759 B2 7/2003 Crosta et al.
6,900,561 B2 * 5/2005 Vlemmings et al. ..... 310/59

* cited by examiner

*Primary Examiner*—Derek S. Boles
(74) *Attorney, Agent, or Firm*—Young & Thompson

(57) ABSTRACT

An apparatus for heating a liquid includes a housing having an internal chamber and a rotor disposed in the chamber. The rotor is preferably cylindrical and operates inside a bore provided by the housing without touching, the shape of the bore preferably being parallel with the exterior surface of the rotor, and a series of openings disposed over the rotor surface. At least one internal passageway in the rotor and elements for: pre-heating some or all the incoming fluid in the chamber; priming the chamber initially; cooling certain temperature sensitive components; injecting fluid into a partially evacuated volume; developing a vacuum state during operation expeditiously.

26 Claims, 17 Drawing Sheets

APPARATUS AND METHOD FOR HEATING FLUIDS

BACKGROUND OF THE INVENTION

The invention relates generally to the heating of liquids, and specifically to those devices wherein rotating elements are employed to +generate heat in the liquid passing through them. Devices of this type can be usefully employed in applications requiring a hot water supply, for instance in the home, or by incorporation within a heating system adapted to heat air in a building residence. Furthermore, an economic portable steam generator could be useful for domestic applications such as the removal of winter salt from the underside of vehicles, or the cleaning of fungal coated paving stones in place of the more erosive method by high-pressure water jet.

Of the various configurations that have been tried in the past, types employing rotors or other rotating members are known, one being the Perkins liquid heating apparatus disclosed in U.S. Pat. No. 4,424,797. Perkins employs a rotating cylindrical rotor inside a static housing and where fluid entering at one end of the housing navigates through the annular clearance existing between the rotor and the housing to exit the housing at the opposite end. The fluid is arranged to navigate this annular clearance between static and non-static fluid boundary guiding surfaces, and Perkins relies principally on the shearing effect in the liquid, causing it to heat up. A modern day successor to Perkins is shown in U.S. Pat. No. 5,188,090 to James Griggs. Like Perkins, the Griggs machine employs a rotating cylindrical rotor inside a static housing and where fluid entering at one end of the housing navigates past the annular clearance existing between the rotor and the housing to exit the housing at the opposite end. The device of Griggs has been demonstrated to be an effective apparatus for the heating of water and is unusual in that it employs a number of surface irregularities on the cylindrical surface of the rotor. Such surface irregularities on the rotor seem to produce an effect quite different than the forementioned fluid shearing of the Perkins machine, and which Griggs calls hydrodynamically induced cavitation. Also known as the phenomena of water hammer in pipes, the ability of being able to create harmless caviation implosions inside a machine without causing the premature destruction of the machine is paramount. The Giggs machine would seem to take time to reach steady state conditions before reaching maximum efficiency, due most likely to the difficulty of such surface irregularities becoming sufficiently primed with fluid at stary up. Such surface irregularities, at the commencement of rotor rotation, may be largely empty of fluid, and as such, there is likely a time lag before sufficient fluid is, by the severe turbulent flow conditions, in the gap between rotor and housing, able to enter into these surface irregularities to produce the desired hydrodynamically induced vatitational heating of the fluid flowing through the machine. A further feature of Griggs is that the maximum effect is limited by the size of volume pocket void that exists for each surface irregularity. For instance, a surface irregularity in the form of a drilled hole has a certain diameter and depth which determines the maximum quantity of fluid it can hold. During operation of the Griggs machine, this quantity of fluid is reduced, most likely reduced quite substantially in order to create the desire effect of a very low-pressure region in and about the hole. For certain applications, there may be advantage through the deployment of deeper holes in the rotor, as compared to the depth of holes taught by Griggs, for improved shock wave transmissions from the cavitiation implosion zones to maximum power efficiency in performance. Furthermore, the protection of bearings and seals against deterioration caused by high temperatures and pressures in the fluid entering and exiting the machine is important. The use of detachable bearing/seal units mounted externally to the housing is a known solution that is used to space the bearing and seal members further away from the hot regions of the machine. However, there would be advantage if some or all the bearings and seals could be disposed in a cooler region in the machine, thereby saving the additional complication and expense of having to use such detachable bearing/seal units. There therefore is a need for a new solution whereby the effects of high temperatures and pressures are less harmful to such bearings and seals.

The present invention seeks to improve on some or all of the above mentioned limitation of earlier machines without undue complication and whereby the cavitational heating of the fluid by shock wave transmissions from the cavitation implosion zones can be maximized.

There is also a need for a new solution whereby such surface irregularities confronting the annular chamber, as well as any internal voids or cavities within the rotor itself, can be primed with fluid prior to the commencement of rotation of the rotor.

SUMMARY OF THE INVENTION

It is therefore an object of the present invention to provide a new and improved mechanical heat generator, capable of operating under strong vacuum conditions, that addresses the above needs.

A principal object of the present invention is to provide a novel form of water heater steam generator apparatus capable of producing heat at a high yield with reference to the energy input. It is a still further object of the invention to provide a method for doing so.

It is a still further object of the invention to alleviate or overcome some or all of the above described disadvantages of earlier devices, and thereby be able to generate an improved shock wave transmission by the cavitiation implosion zones towards maximizing the effect for the purpose of obtaining an improved performance from the unit.

It is a preferred feature of the invention that the entry point for the fluid entering the chamber is central or close to the center axis of the drive shaft, preferably coincident with the axis of rotation of the rotor. The fluid, on entering the device and arriving in the central chamber to come into contact with the revolving rotor, is propelled radially outwards in a generally spiral path, until redirected by the interior shape of the housing. The fluid on entering the annular clearance between rotor and housing is heated, firstly by the shearing effect on the fluid between static and dynamic opposing boundary surfaces, and secondly from the deployment of numerous openings or cavitation inducing depression zones on at least the exterior surface of the rotor. Although it is a preferable feature of this invention to position a peripheral exit passage in the housing for the heated fluid to leave the device at a location described as radially outwardly of the annular clearance, the exit passage may alternatively be positioned radially inwardly of the annular clearance to be adjacent the flanking wall of the rotor. With respect to Griggs, both the fluid entry and exit points have the same elevation in the internal chamber and are both positioned radially inwards of the annular heat generating working chamber. It should be noted however, that may of the inventive improvements described in the present invention may also apply to good effect were the entry and exit passages positioned in the manner taught by Griggs, and for that matter, when the housing are prepared to accept additional detachable bearing/seal units.

As the fluid rides over each opening or depression zone in turn, it is squeezed and expanded by the vacuum pressure conditions occuring in the zone, and the condition of cavitation together with accompanying shock wave behaviour, as the fluid traverses across the surface of the rotor, liberates a release of heat energy into the fluid. Although natural forces such as cavitation vortices are known to occur in nature, the forces to be generated in the present invention are usually viewed as an undesirable consequence in man-made appliances. Such destructive forces, in the form of cavitation bubbles of vacuum pressure, are purposely arranged to implode within locations in the device where they can do no destructive harm to the structure or material integrity of the machine. In this respect, certain rotors here disclosed feature openings or depression zones in the form of holes arranged to interconnect, either directly or via a flow restricting throttle, with an internal chamber provided in the interior of the rotor towards broadening the occurance in the number and range of resonant frequencies for an additional influence in the formation of cavitation bubbles.

It is therefore an aspect of this invention to be able to rapidly and successively alter and disrupt the path of fluid flowing between the rotating and stationary elements in the annular clearance as it passes across these depressions which during operation of the device may become largely empty vessels of vacuum pressure, and where the deployment of openings or depression zones act in diverting a quantity of the passing fluid into these openings or depression zones for the formation of cavitation vortices inside these voids and their attendant shock waves and water hammer effects. In addition, certain of the rotors disclosed in the present invention allow the admission of further fluid into these voids from a chamber internally disposed in the rotor. The fluid once subjected to water hammer returns back to the annular passage with an increase in temperature and this continues in a continuous process until the fluid leaves the device. As such, each of said openings or depression zones becomes in effect individual heating chambers for the device. For certain applications, some or all of such individual heating chambers may be deeper in depth than deployed previously for the creation of an amplified cavitational effect by the device.

It is also a preferred feature of this invention to minimize the risk of bearing and seal failure. In this respect, the examples show that the positioning of the fluid inlet axially adjacent the inner end of the drive shaft has the principle advantage that the support bearing receives a copious supply of cooling fluid, while also removing the requirement for any type of seal member to be located between the housing and shaft at this end of the device. The transmission of power to the device without any direct mechanical connection would remove the requirement for a seal member at the opposite end of the device. However, when required, fluid passageways can be incorporated to provide the seal with sufficient fluid, at least for cooling and/or lubrication purposes.

In one form thereof, the invention is embodied as an apparatus for the heating of a liquid such as water, comprising a static housing having a main chamber and at least one fluid inlet and at least one fluid outlet in fluid communication with the main chamber. Preferably, the fluid inlet and/or the fluid outlet are located in a static member such as the housing. A rotor disposed centrally in the chamber and mounted for rotation within the chamber about an axis of rotation, and the rotor in spaced relation with respect to the housing to provide a generally annular passage for fluid to travel from the inlet towards the outlet. The rotor is provided with at least a single interior passageways forming a vessel therein as well as a series of openings formed on an exterior surface thereof confronting fluid in the passage. The interior chamber is the rotor may initially be primed with fluid prior to commencement of rotor rotation. Once the rotor is rotating at high-speed, fluid entering the annular passage either from one end; or by entrance means provided along the surface length of the rotor; or a combination of one end as well as by entrance means provided along the surface length of the rotor; is caused to be heated as it travels in said annular passage in a direction towards the fluid outlet by passing a multitude of cavitiation implosion zones in about said openings. Preferably, the rotor and the drive shaft have a common axis of rotation. The rotor element can be said to interact with the surrounding housing to produce two quite distinct regions or heating stages, the first region being the annular clearance between rotor and surrounding housing which acts as the primary heat generating region or stage, the second region being disposed internally in the rotor element and acting as a pre-heating stage for at least a proportion of the incoming fluid from the inlet, and where the series of openings on the exterior surface of the rotor are communicating with at least one of these two regions.

A fluid source tank should preferably be situated above the height of the device in order to provide the device with water at the inlet connection. However, mains water pressure may alternatively be used at the inlet, with a pressure reducing valve to lower the pressure level, if necessary.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which.

DETAILED DESCRIPTION OF THE FIRST ILLUSTRATIVE EMBODIMENT OF THE INVENTION

Figure 1:
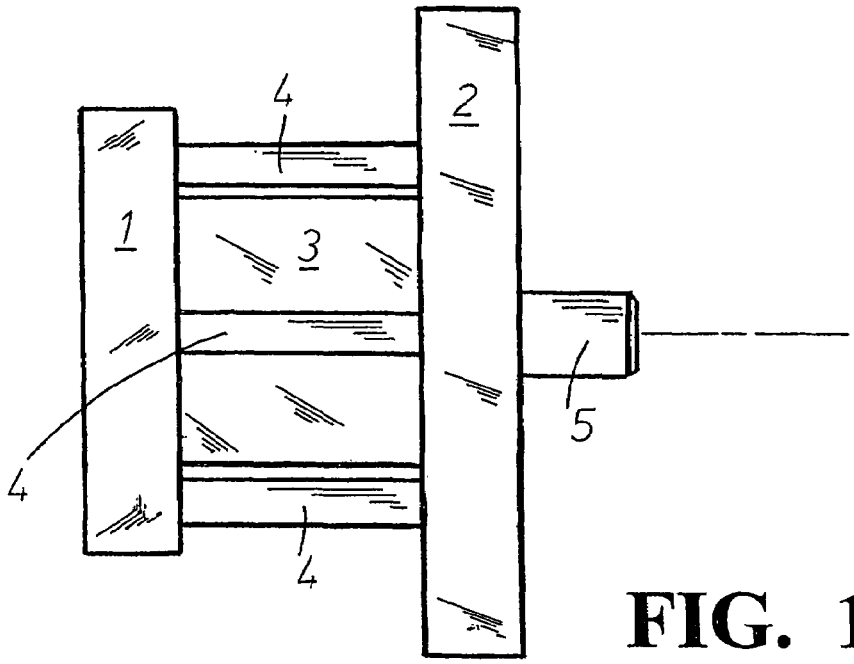
FIG. 1 is a longitudinal exterior view of the heat generating device in according to the present invention.
Figure 2:
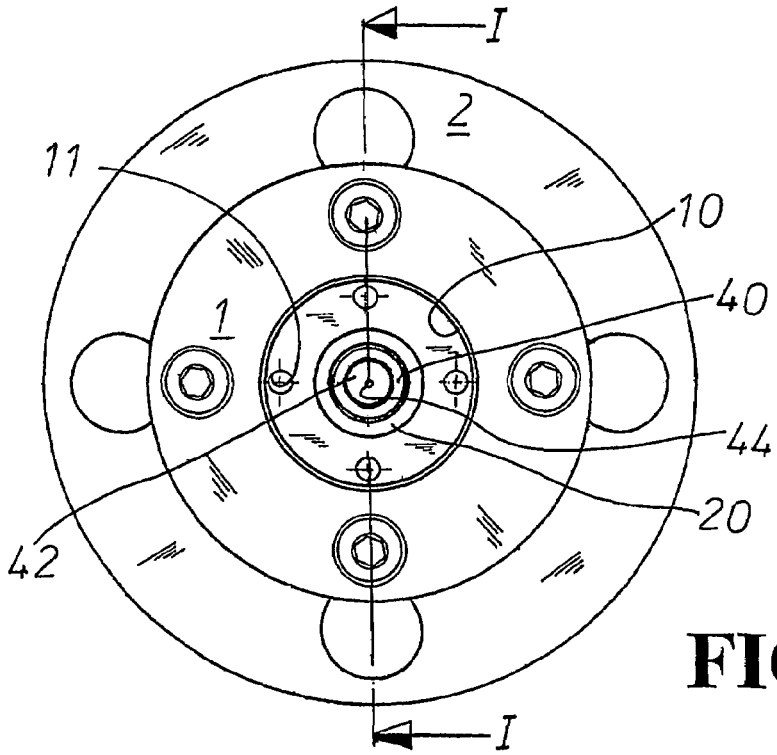
FIG. 2 is an exterior end view of the heat generating device taken on the left side of FIG. 1.
Figure 4:
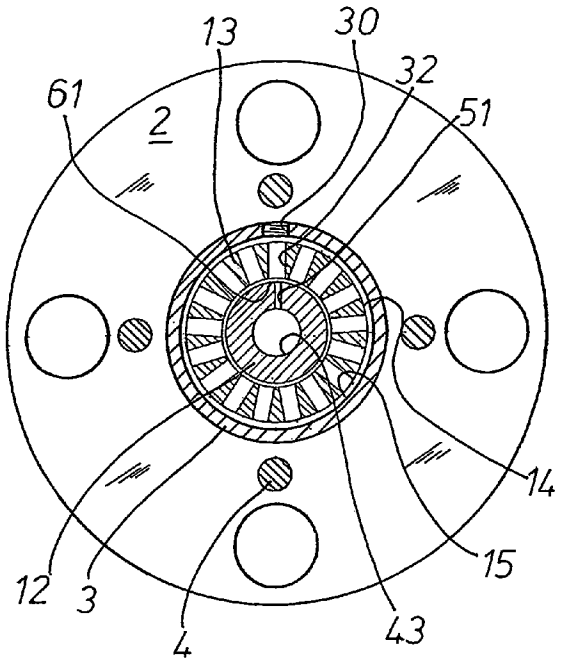
FIG. 4 is a transverse sectional view of the device taken at section II-II in FIG. 3.

Referring to FIGS. 1 to 4, the device shows a housing structure comprising rear housing member 1, front housing member 2 and a tubular central housing member 3. Housing member 3 with bore 15 is a sleeve which spans across from end face 6 of rear housing member 1 to the face 7 of the front housing member 2 and the space inside is the main chamber of the device. Four screws 4 are arranged to engage members 1, 2 with member 3 thereby sandwiched in-between. Drive shaft 5 is shown protruding out from front housing member 2 in FIG. 1. The rear view of housing member 1 in FIG. 2 shows threaded fluid intake connection 10, also called the "inlet" or "intake", and well as fluid ports 11 which become more clearly depicted with reference to FIG. 3. The inlet 10 is shown rather large in diameter in order for access to be obtained for a drill in order that fluid ports 11 can be created, the ports 11 fluidly communicate inlet 10 with the end face 6 of the rear housing member 1. In later embodiments, ports 11 are omitted so inlet 10 need not be so large.

As shown in these various embodiments, the interior of the heat generating device is an internal or main chamber largely occupied by the rotating component, and the rotatable unit, typically called a rotor. The rotor resides radially inwardly of bore 15 in the main chamber. The rotating component is part drive shaft 5 and part rotor. The rotor comprises two elements 12,13, the first element is the central portion 12 preferably formed integrally with drive shaft 5, and the second element is a sleeve portion 13 and which is a heat shrink on central portion 12. The rotor sleeve portion 13 with exterior surface 14 is sized accordingly to have the required working clearance in bore 15 to allow the passage of fluid, this annular passage with a working clearance may alternatively called annular fluid volume. Although rotor exterior surface 14 and bore 15 are shown to be parallel with respect to the longitudinal axis of the drive shaft, either or both may alternatively be inclined. The term "annular passage" here used in the present invention is intended to also cover such variations in the outer shape of the rotor as well as the shape of the bore, for example, a thin cone-shaped annular passage disposed between the static housing and the rotatable rotor unit.

Drive-shaft 5 is supported in the housing by a pair of bearings, plain bearing 20 disposed in rear housing member 1 and bearing 22 disposed adjacent rotary seal 21 in front housing member 2. Seal 21 is preferably disposed on the opposite axial side of the housing to where the inlet 10 is disposed. Seal 21 may typically be a rotary lip seal or double lip seal capable of working under pressure as well as under negative pressure conditions, although it should be noted all embodiments may easily be adapted to incorporate other types of seals that are readily available. For instance, a spring-loaded face seal could be used operating against the end face of the rotor. Should the transmission of power to the device be performed without any direct mechanical connection such as the example here depicted of an externally protruding drive shaft 5, the requirement for a seal would be removed. Bearing 20 positioned close to the fluid inlet 10 is largely unaffected by heat build-up in other areas of the device. As shown, bearing 20 is of a type that can operate dry or wet depending on what operating conditions prevail, and may be of a type known as a steel backed PTFE lead lined composite bearing. Other forms of bearing types may be used however, and furthermore, rear housing member 1 may easily be modified to allow the addition of some form of sealing device at one end or both ends of this bearing 20, and where such a bearing would preferably be self-lubricating.

Rear housing member 1 is provided with a circular register 25 at end face 6 on which one end 26 of housing sleeve member 3 is engaged, and similarly, front housing member 2 has a similar circular register 27 at end face 7 on which the opposite end 28 of housing sleeve member 3 is engaged. Sealant or some form of robust sealing device such as static seals disposed between these joining surfaces ensures on the one hand that the main chamber is not leaking fluid to the outer environment when the device is at rest, and on the other hand, suck air into the chamber due to the vacuum conditions prevailing when, the device is operational.

The rotor portions 12, 13 as the rotor component is positioned in the housing members 1, 2, 3 with respect to end faces 6, 7 with sufficient axial clearance to avoid contact. The exterior surface 14 on the rotor terminates at first and second planar end faces of the rotor. There therefore can be said to be clearance volumes at opposite ends of the rotor, and for this particular embodiment of the present invention, the clearance volume nearer to end face 6 is where the greater quantity of fluid arrives into the chamber via ports 11.

Housing sleeve member 3 is provided with a threaded fluid exit connection 30, also called the "exit or outlet", and which, preferably, is disposed radially outwardly from said rotor portions 12,13. Exit 30 is slightly displaced from the position shown in these drawings to avoid interference between connecting pipe-work and screws 4. Although less preferable, the exit 30 could be positioned in the front housing members 2 instead of sleeve 3.

Rotor sleeve portion 13 is provided with a plurality of openings in the form of nine circumferential rows of radial holes spaced about the rotor exterior surface 14 along the longitudinal axis of the rotor. As shown in this particular example, each row having eighteen such holes, the first row of openings nearer the inlet 10 denoted by reference numeral 31 where the last row of openings nearer the exit 30 denoted by reference numeral 32. Although here described with eighteen holes per row, the actual number as well as their physical dimensions may be varied to suit the intended application. The use of so many holes can mean about 40% of the total rotor operational surface is exposed to openings. In practice, it is usual for more than one row of holes to be deployed on the rotor, and for reasons of compactness, it is preferable that first, third, fifth, seventh, ninth rows of holes out of phase by ten degrees from the intervening rows so that the rows can be spaced closer together across the axial length of the rotor than they would were they all phased together.

Figure 3:
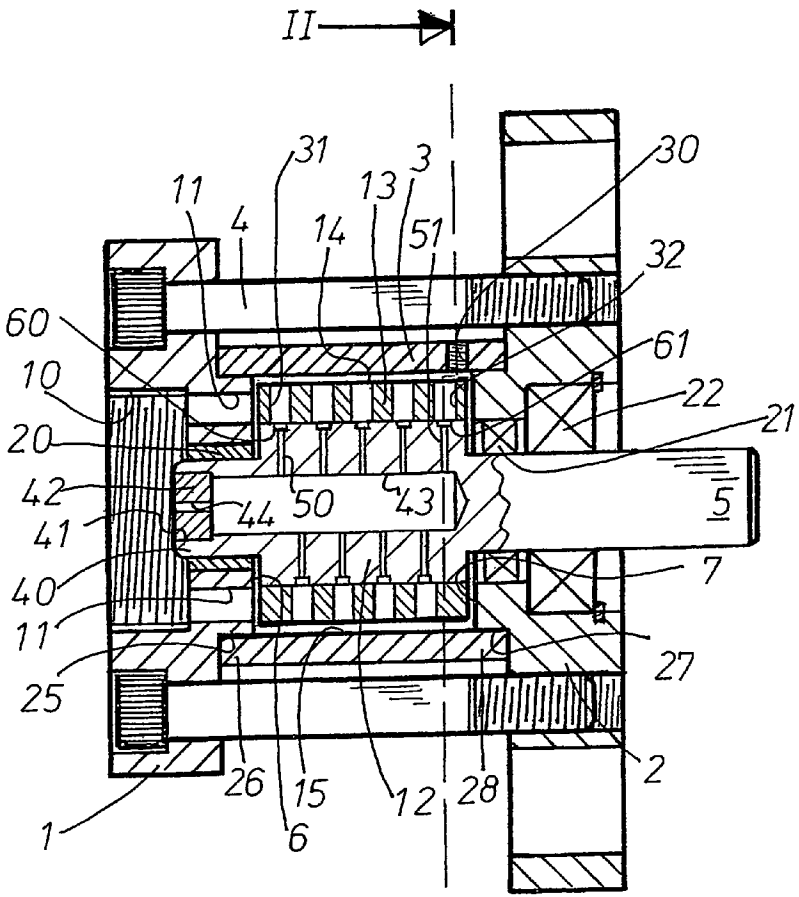
FIG. 3 is a longitudinal sectional view of the heat generating device taken along line I-I in FIG. 2 according to the first embodiment of the present invention with one form of rotor having a series of openings fluidly linked to a single throttling conduit.

The inner shaft end 40 of rotor central portion 12 protrudes towards inlet 10, and is provided with an entrance port denoted by reference numeral 41 leading to interior longitudinal passageway 43. Longitudinal passageway 43 is tube-like in shape. Entrance port 41 is arranged to be in permanent communication with inlet 10, and longitudinal passageway 43 forms part of the interior passageways or vessel disposed inside the rotatable unit. In this embodiment, plug 42 is fixed in position at entrance port 41, plug 42 is provided with a relatively small throttle hole 44 which acts as an orifice and thereby allowing some fluid entering the device at inlet 10 to pass into the interior passageways. The interior passageways may also comprise as here shown a number of radial holes such as 50, 51 which are located in the central portion 12, all these holes communicating with longitudinal passageway 43. Although only radial holes 50, 51 are mentioned for the first and ninth row of openings 31, 32, intervening rows may also be provided with a respective radial hole as shown in FIG. 3. As shown, the central portion is provided with a series of annular fluid distribution grooves, and where each radial hole 50, 51 may be arranged to meet a respective annular fluid distribution groove 60, 61, which is provided to allow fluid in longitudinal passageway 43 to flow through any respective hole 50 and groove 60 combination to reach all the individual openings in the associated row of openings 31. As shown, all the other rows of openings are also provided with their own respective hole and groove combination, but it should be appreciated, depending on the intended application, that certain rows of openings may no-longer be required to be fluidly connected to longitudinal passageway 43 by such hole and groove combinations. Throttle 44 in plug 42 acts in restricting the amount of fluid from inlet 10 able to enter into longitudinal passageway 43, as in this embodiment it is intended that the main or primary flow path through the device from inlet 10 to exit 30 travels via ports 11 to reach the annular clearance volume surrounding the exterior 14 of the rotor component. The fluid throttling conduit therefore prevents the larger quantity of fluid from travelling through the interior passageways in the rotor and reaching the annular passage by this route. Depending on the size of the throttle 44 in plug 42, and other factors to do with speed of rotor rotation, temperature of fluid etc, the vacumm created "downstream" of the fluid throttling conduit is variable. For this rotor form, the relatively smaller amounts of fluid are able to reach the annular passage surrounding the exterior 14 of the rotor component via the interior passageways of the rotor reaches the openings, such as rows of openings 31, 32, by means of travelling through longitudinal passageway 43 and via respective hole and groove pairs, 50,60 and 51 61.

The interior passageways in the rotor being surrounded by the material composition of the rotor provide a heat transmitting surface to the fluid passing through these passageways. This acts to pre-heat the fluid before it arrives in the annular passage where the plurality of openings operating there are producing the main heating effect on the fluid.

To prime the device before starting, fluid admitted through inlet 10 is allowed to percolate into the interior of the central rotor portion 12 thereby flooding all the available interior space in the vessel, in particularly the longitudinal passageway 43 and interconnecting network of smaller passagways leading to the openings provided in the rotor sleeve portion. In this situation, fluid passing through fluid throttling conduit 44 fills up the interior passageways comprising the longitudinal passageway 43, radial holes, 50, 51, grooves 60, 61 as well as the various rows of openings 31, 32. Any air originally trapped in the device is thereby expelled and the device is now primed with fluid prior to the commencement of rotor rotation.

Then to operate the device, the prime mover is switched on in order to provide mechanical power in the form of driving torque and rotation to shaft 5. On starting, fluid initially residing in the longitudinal passageway 43 and interconnecting network of smaller passageways, becomes rapidly expelled from the rotatable unit by centrifugal force, thus creating a partial vacuum condition in these regions, and depending on the size of throttle hole 44 used, this region remains under partial vacuum conditions as the amount of fluid entering via hole 44 is restricted.

Fluid such as cold water enters the device through inlet 10, and for primary flow path, the fluid passes through ports 11 to that side of the rotor adjacent end face 6 from where the general disturbance by the rotating rotor propels the water radially outwards, bore 15 redirects the water into the annular passage between bore 15 and exterior surface 14. Some heating of the water occurs due to the fluid being sheared between the static surface of the bore 15 and the moving surface 14, but the majority of the heating of the water occurs due to being subjected to turbulent flow conditions caused by the many and varied negative pressure conditions in the regions neighbouring the multitude of openings 31, 32. In the case of the secondary flow path, the continuing quantity of water from inlet 30 passing through the throttle hole 44 in plug 42 enters into the interior vessel region of the rotor 12, 13 where partial vacuum conditions are created, may cause this additional fluid to go through a rapid phase change to water vapour or steam. The two fluid steams meet in the annular clearance volume. The vacuum or partial vacuum condition thereby created in the interior of the rotor creates greater disturbances in the passing fluid flowing in the primary pathway between inlet 10 and exit 30.

Figure 6:
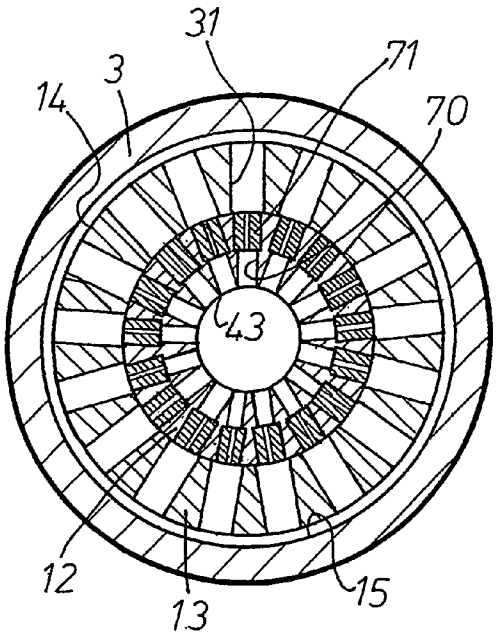
FIG. 6 is a transverse sectional view of the device taken at section III-III in FIG. 5.
Figure 5:
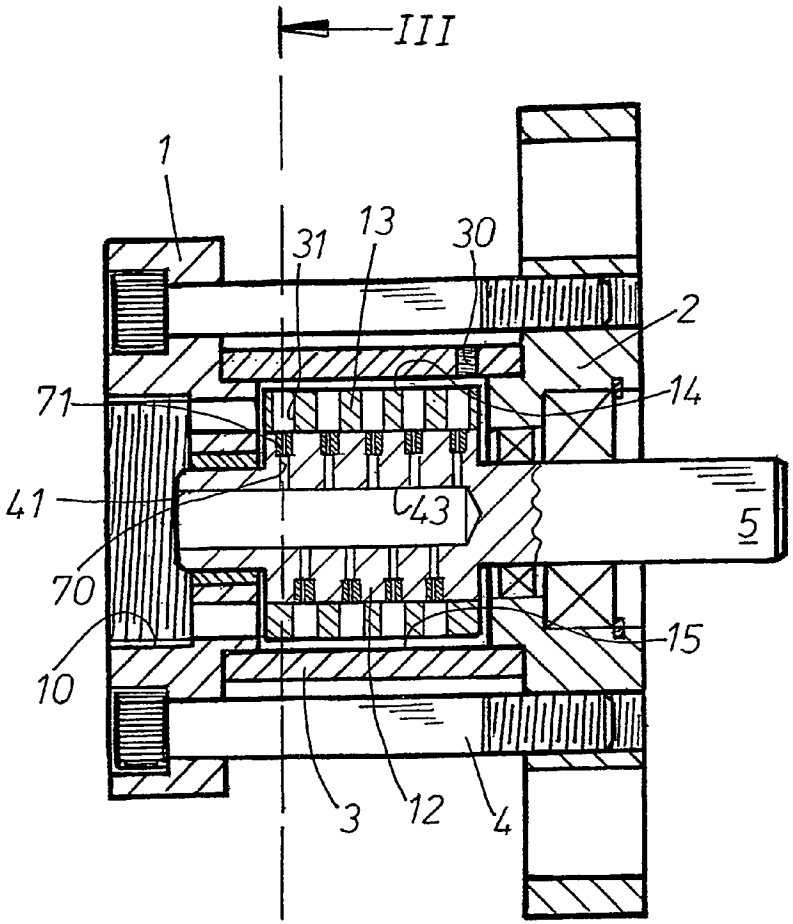
FIG. 5 is a longitudinal sectional view of the heat generating device with a modified form of rotor having a number of individual fluid throttling conduits associated with certain openings.
Figure 7:
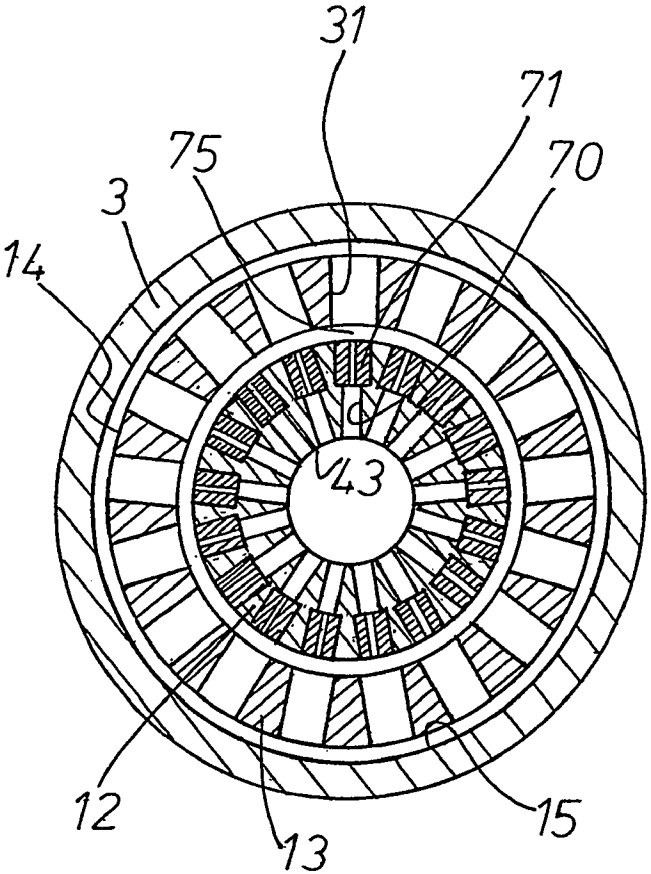
FIG. 7 is a sectional view of a modified rotor having an internally disposed annular fluid distribution groove for connecting the throttling conduits with an individual row of openings.
Figure 8:
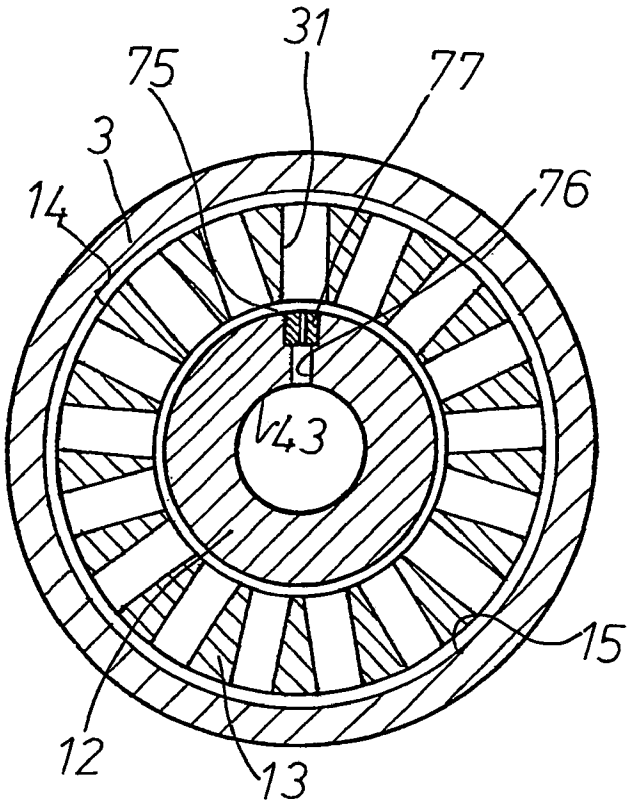
FIG. 8 is a sectional view of a modified rotor having a single throttling conduit individual row of openings.

As an alternative to incorporating a single plug 42 with throttle hole 44 as shown in FIG. 3, FIGS. 5 to 8 disclose a number of alternative interior locations within the rotatable unit for achieving fluid flow restriction for the secondary flow path from inlet 10 to exit 30. In FIGS. 5 & 6, the entrance port 41 located in central element 12 leading to longitudinal passageway 43 does not contain a plug, hence the flow arriving at inlet 10 is able to enter the interior of the rotor portions 12, 13 unrestricted. Each row of openings, such as first row 31, is connected to the longitudinal passageway 43 by a radial hole 70 and its associated individual throttle 71 best seen in FIG. 6. Hence, here the fluid arriving into the longitudinal passageway 43 is propelled by centrifugal force through the radial hole 70 and throttle 71 before entering an individual opening 31. As before, the rotatable unit 12, 13 can be primed before operation is commenced as the fluid seep past the throttles 71 thereby filling the interior of the rotatable unit, and once operating, the pressure build up in the radial hole 70 below each throttle 71 causing an injection of a small quantity of fluid into the opening 31. However, as the amount of fluid continuously being injected is small compared to the volume of each individual opening, the partial vacuum conditions in the opening during operation of the device remain largely unaffected. FIG. 7 shows the addition of a groove 75 so that the flow through the throttles 71 may be evenly distributed to the complete row of openings 31. FIG. 8 discloses the use of a single radial hole 76 and throttle 77 for reasons of improved economy of manufacture, and where groove 75 allows the fluid to communicate with all openings 31 in that particular row of openings.

Figure 10:
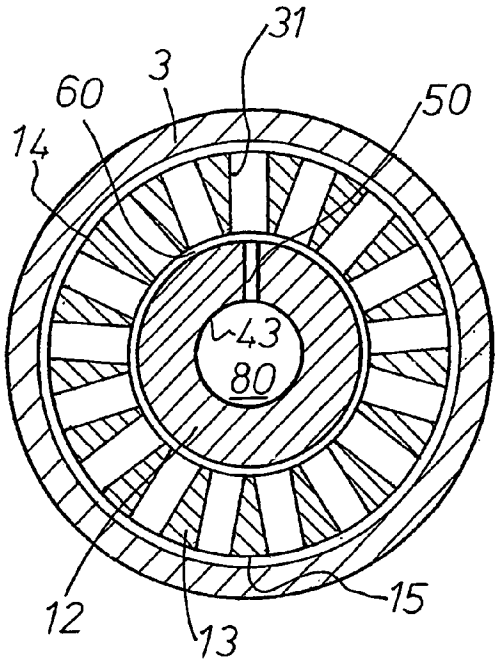
FIG. 10 is a transverse sectional view of the device taken at section IV-IV in FIG. 9.
Figure 9:
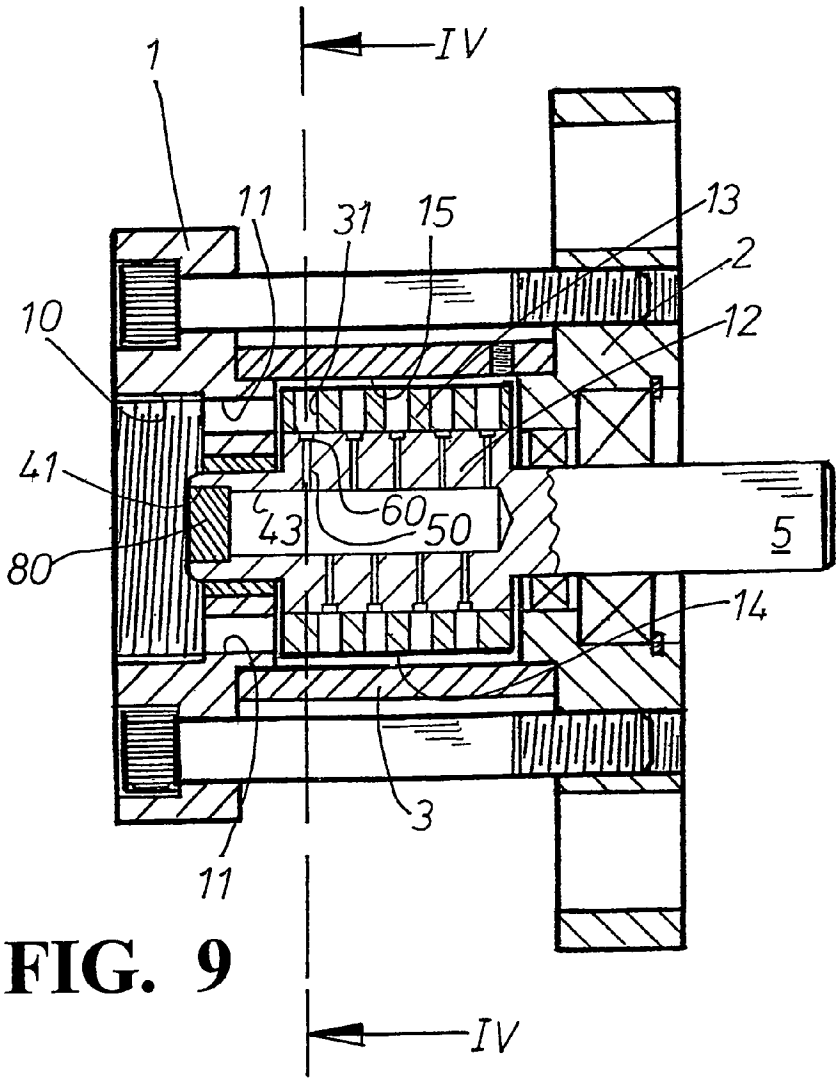
FIG. 9 is a longitudinal sectional view of the heat generating device with a modified form of rotor where the interior longitudinal passageways in the rotor is closed at its outer end by a plug and where the interior vessel is fluidly connected to the openings.
Figure 13:
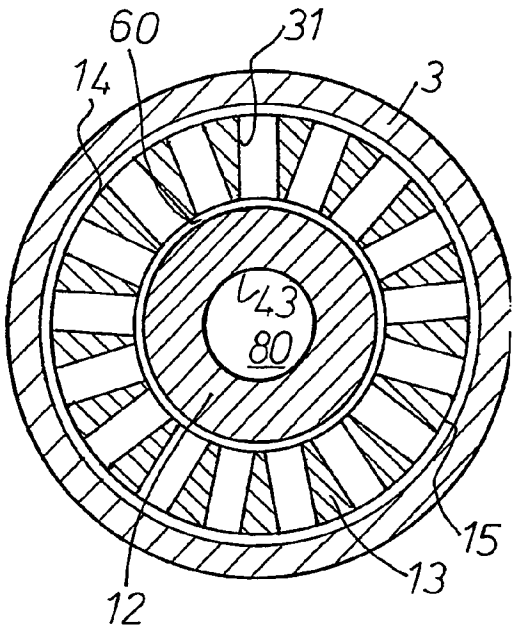
FIGS. 11 to 13 are transverse sections depicting a modified for of rotor to that rotor of FIG. 10.
Figure 12:
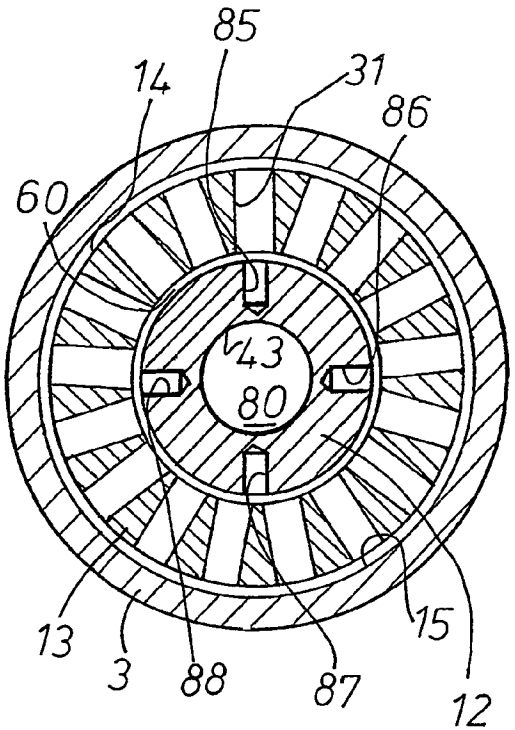
Figure 11:
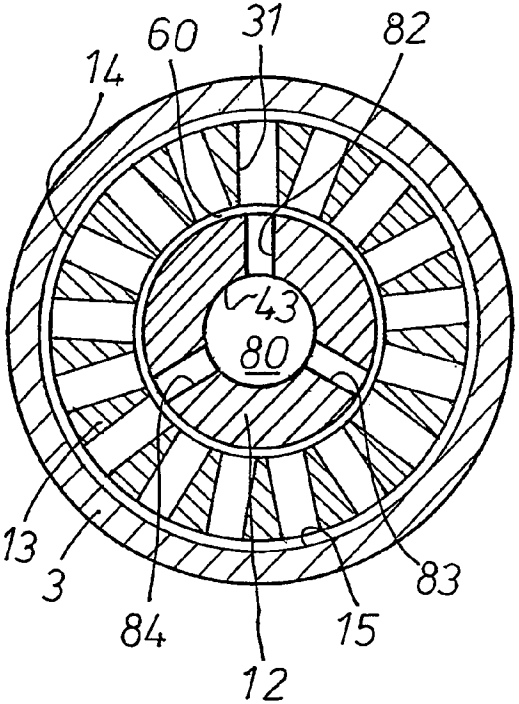

In FIG. 9, a solid plug 80 at the entrance port 41 in the central rotor portion 12 prevents the flow of fluid from inlet 10 directly into longitudinal passageway 43. To prime the device and remove any air trapped in the interior of the rotor, fluid from the inlet 10 can pass through ports 11 to enter the annular clearance between rotor exterior surface 14 and bore 15. As the fluid fills up this space, it can enter into the interior of the rotor portions 12, 13 by passing through the openings, grooves, and radial holes, for instance, 31, 60, 50 to reach longitudinal passageway 43. As soon as the rotatable unit 12, 13 is rotating at high speed, centrifugal force causes that fluid in the interior to flow out from the longitudinal passageway through 50, 60, 31 to reach the annular working clearance between exterior 14 and bore 15. A rapid evacuation or partial evacuation of the fluid in this internal region or vessel, thus may produce a good vacuum condition near to the openings to help provide a more rapid heating of the fluid passing through the annular working chamber. FIG. 11 discloses the use of three radial holes 82, 83, 84 an alternative to the single radial hole 50 in FIG. 10. FIG. 12 discloses the use of four bottom-ended holes 85, 86, 87, 88 in central rotor portion 12 which act to capture fluid when the device is first primed. FIG. 13 discloses a central rotor portion 12 with only a groove 60 to interconnect all openings in the first row 31. The groove 60 helps in priming the device so that any air pockets present in certain of the openings can be expelled by the incoming fluid into the groove 31 from the openings 31. Here as for the device of FIG. 12, longitudinal passageway 43 is redundant.

Figure 14:
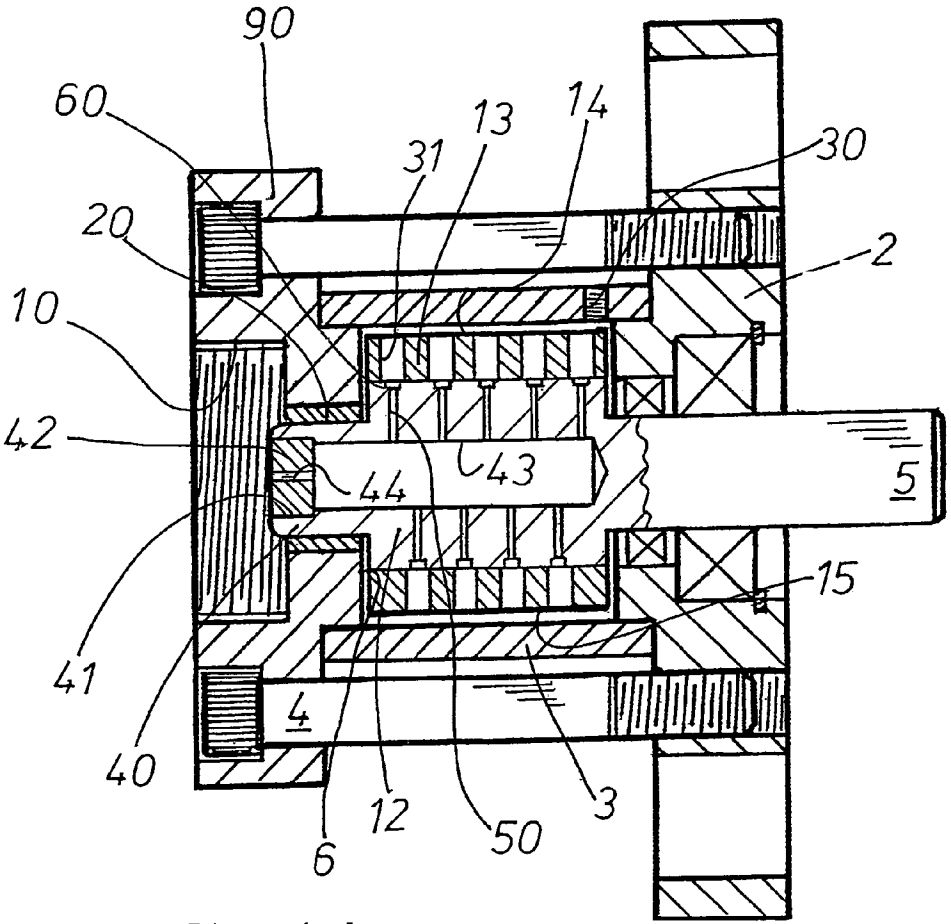
FIG. 14 is a longitudinal sectional view of the heat generating device having a modified housing for the fluid inlet and where the rotor is of the type shown in FIG. 3.
Figure 16:
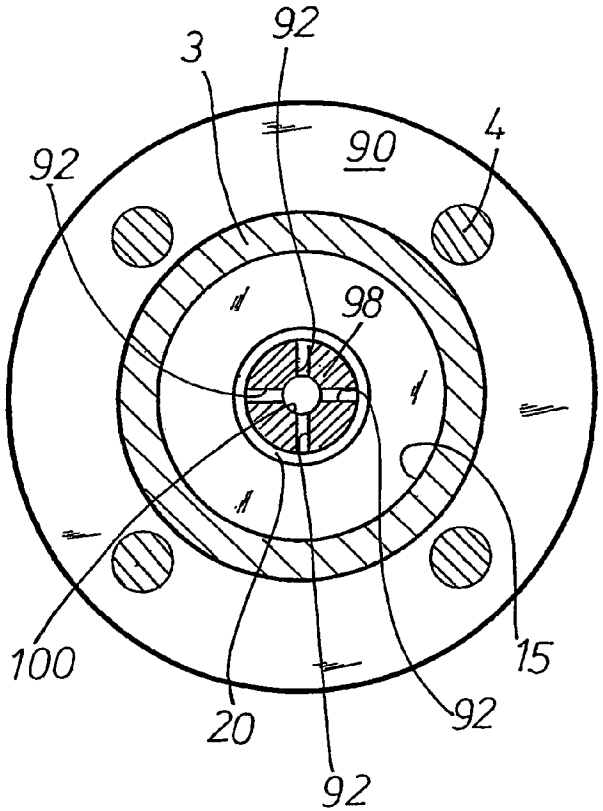
FIG. 16 is a transverse sectional view of the device taken at section V-V in FIG. 15.

FIG. 14 discloses a modified rear housing member 90 where in contrast with the earlier rear housing member 1, ports 11 are omitted. Therefore, the end face 6 of rear housing member 90 in FIG. 14 does not include a port, and as such, there is not the earlier primary flow path. Here fluid entering the device at inlet 10 can now only reach the annular working clearance between rotor exterior surface 14 and bore 15 by first entering longitudinal passageway 43. Entrance port 41 located at inner shaft end 40 of rotor central portion 12 carries a plug 42 with a throttle hole 44. The device may be primed with fluid prior to starting by allowing fluid at inlet 10 to flood the interior of the rotor portions 12, 13 as well as the annular clearance between exterior surface 14 and bore 15. The fluid passes through the throttle hole 44 into the longitudinal passageway 43 and interconnecting network of smaller passages, radial hole 50 and groove 60, leading to openings 31 on the rotor sleeve portion 13. Although some fluid can enter the main chamber of the device by flowing past the running clearance between inner end 40 and surrounding bearing 20, in practice and provided that the exit 30 is suitably restricted by an external flow valve (not shown), the cavitational effect produced in the liquid passing through the device can be quite pronounced.

Figure 15:
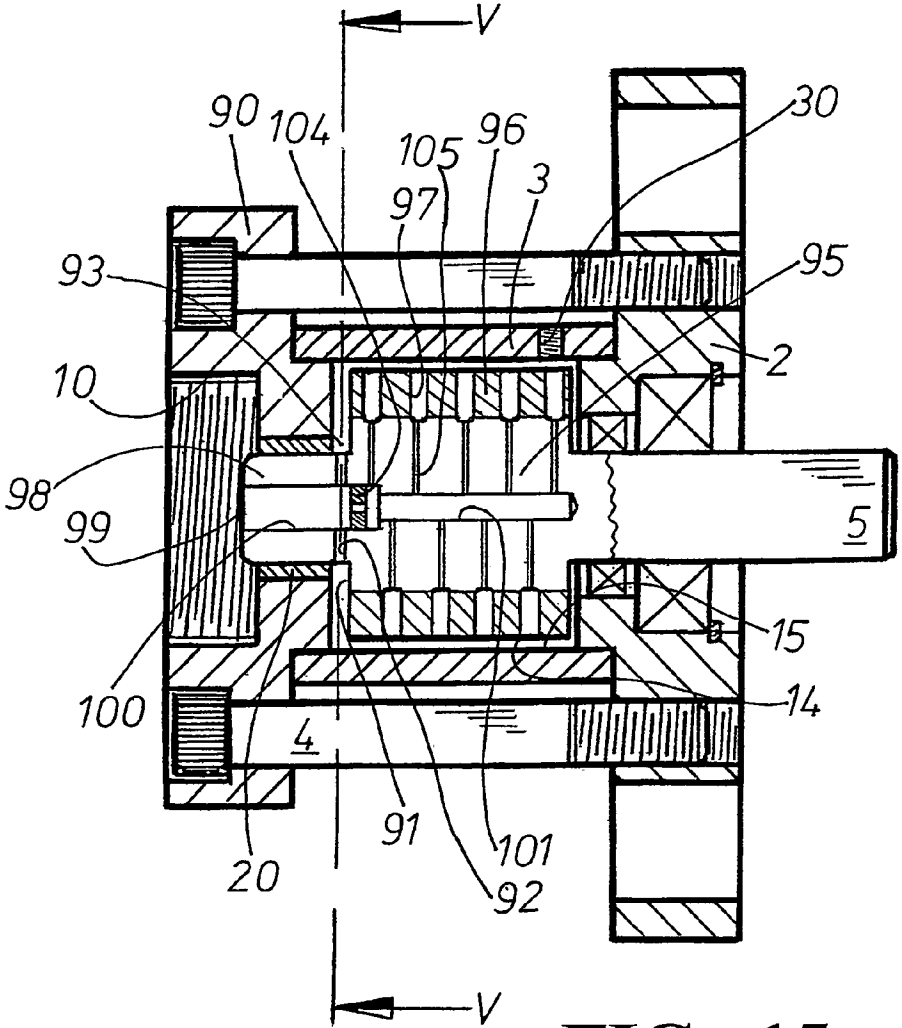
FIG. 15 is a longitudinal sectional view of the heat generating device having the modified housing of FIG. 14 with a further form of modified rotor.

FIG. 15 also shows the modified rear housing member 90 together with a further form of modified rotor assembly comprising central rotor portion 95 and sleeve portion 96. The sleeve portion is provided with several rows of openings such as openings 97 shown as the third row from inlet 10. An inner shaft portion 98 of the central rotor portion 95 is provided with an entrance port 99 that leads to stepped longitudinal passageway 100, 101. In the position on inner shaft portion 98 next to bearing 20 and the end face 91 of the rotor, there are provided at least one radial passage 92 which communicates longitudinal passageway 100 with the axial clearance volume denoted by reference number 93. Positioned further along in longitudinal passageway 100, there is throttle plug 104, and throttle plug 104 is fixed in position at this location such that a number of radial holes, such as hole 105 disposed in the central rotor portion 95, are arranged to fluidly connect with the longitudinal passageways 100, 101 on the "downstream" side of the throttle plug 104. Fluid entering the device at inlet 10 and entering entrance port 99 passes in longitudinal passageways 100 to the point where the radial passages 92 divert the primary flow to the axial clearance volume 93, to one end face 91 side of the rotor from where it is redirected by bore 15 to flow into the annular clearance volume between rotor exterior surface 14 and bore 15. However, the throttle plug 104 provides a secondary flow path, and fluid passing through the throttle plug 104, enters the interior of the rotor to be distributed via the radial holes, such as radial hole 105, to the various rows of openings such as opening 97.

DETAILED DESCRIPTION OF THE SECOND ILLUSTRATIVE EMBODIMENT OF THE INVENTION

Figure 18:
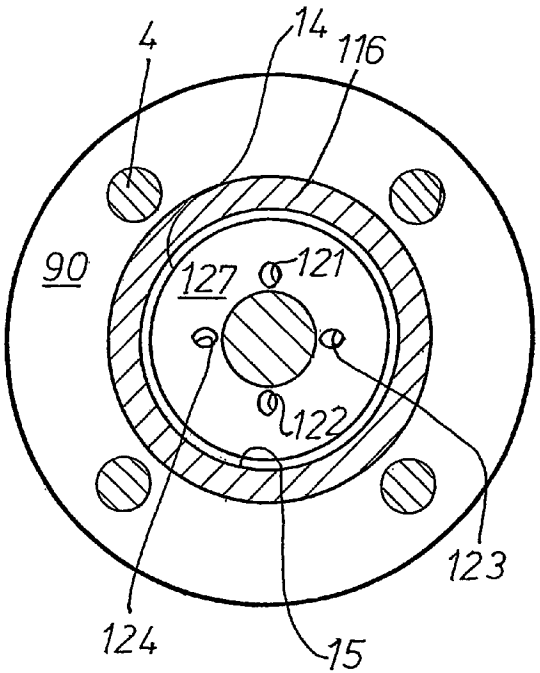
FIG. 18 is a transverse sectional view of the device taken at section VI-VI in FIG. 17.
Figure 17:
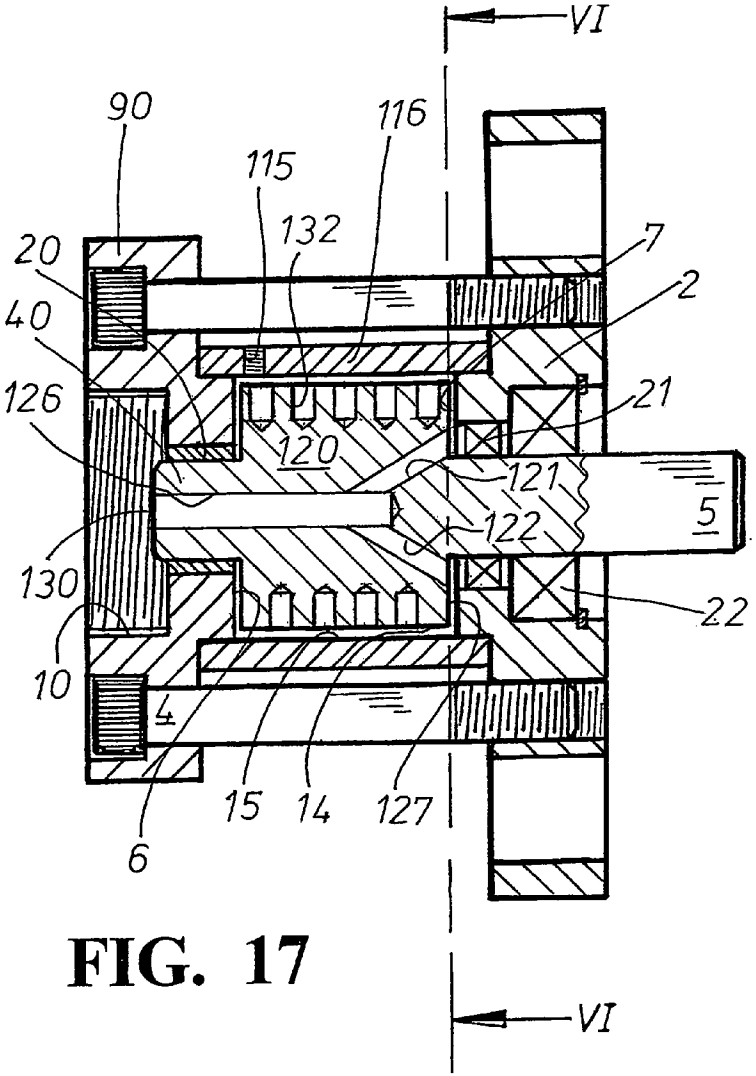
FIG. 17 is a longitudinal sectional view of the heat generating device of FIG. 1, according to a second embodiment of the present invention, and where the openings in the rotor are in the form of radial drilled holes.

In the second embodiment of the present invention depicted in FIGS. 17 & 18, the exit connection for the fluid denoted by reference numeral 115 is disposed in central housing member 116 is a location that is closer to the fluid inlet 10 than to seal 21. As many components are identical to those described for the first embodiment and therefore do not require detailed description, for the sake of simplicity they carry the same reference numerals Whereas in the earlier embodiment, the direction in the flow of fluid from the inlet 10 to the exit 30 could be said to be in one direction from left to right, it is a feature of this as well as the third embodiment of the invention that the flow of fluid through the heat generator is arranged to double back on itself. One purpose of the fluid doubling back on itself is to obtain a better pre-heating of the initially cold fluid before it can enter the annular clearance volume; the second purpose is to attempt to protect the front housing elements 2 and especially the bearing 22 and seal 21 from the high temperatures generated by the heat generator. As a consequence, during operation of the heat generator of the second and third embodiments, the rear housing member remains relatively hot whereas the front housing member is relatively cooler.

As shown, the rotor 120 may be a one-piece component formed with an integral protruding shaft portion 5. The rotor 120 is provided with four inclined passageways 121, 122, 123, 124 connecting with longitudinal passageways 126 on the one hand, and on the other hand, opening on the end face 127 of the rotor 120 as best seen in FIG. 18. Between end face 127 of the rotor 120 and the wall or end face 7 of the front housing member 2, is the volume space where the fluid is propelled radially outwardly by the revolving rotor 120 to be redirected by bore 15 to travel across the annular working clearance as defined by the radial clearance between the rotor exterior surface 14 and the confronting bore 15. The relatively cold fluid entering the device at inlet 10 and the rotor 120 at entrance port 130 flows through passageways 126, 121-124 to reach the volume space between revolving and static faces 127, 7 and be redirected by bore 5 into annular clearance where a number of rows of bottom-ended holes 132 are positioned along the exterior surface 14 of the rotor 120. The initially cold fluid as it flows through passageways 126, 121-124 is pre-heated by the comparatively hot rotor unit 120, while still significantly cold to keep seal 21 and bearing member 22 cool by absorbing further heat from the region adjacent to front housing member 2. As the fluid moves through the annular fluid volume and interacts with the openings/depression zones, heat-generating cavitation conditions are experienced, and the heat energy imparted in the fluid is outputted from the device as the fluid exist the device at exit 115.

Figure 21:
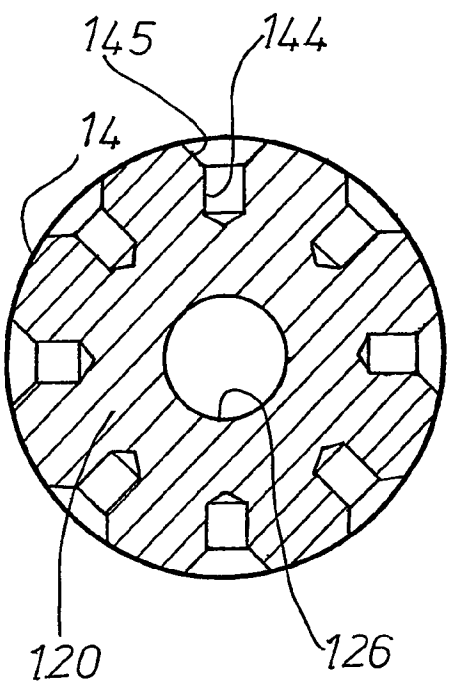
FIG. 21 is exclusively a cross-sectional view of another form of rotor where the openings are bellmouthed.
Figure 20:
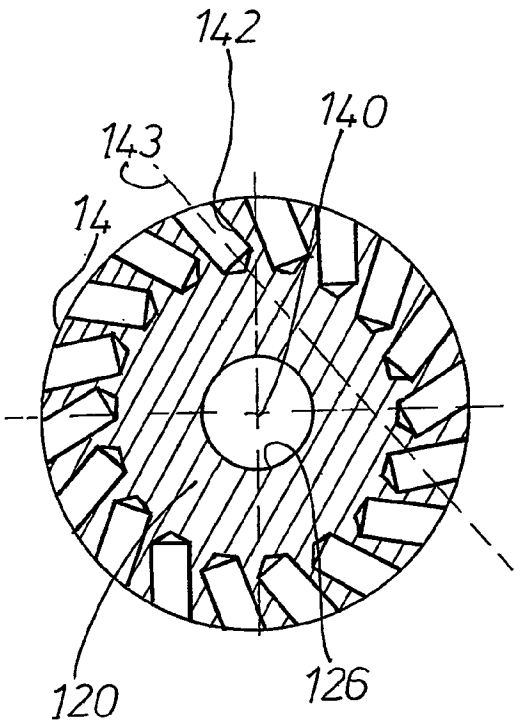
FIG. 20 is exclusively a cross-sectional view of another form of rotor where the radially drilled holes are further inclined with respect to the center of the rotor as compared with FIG. 19.
Figure 19:
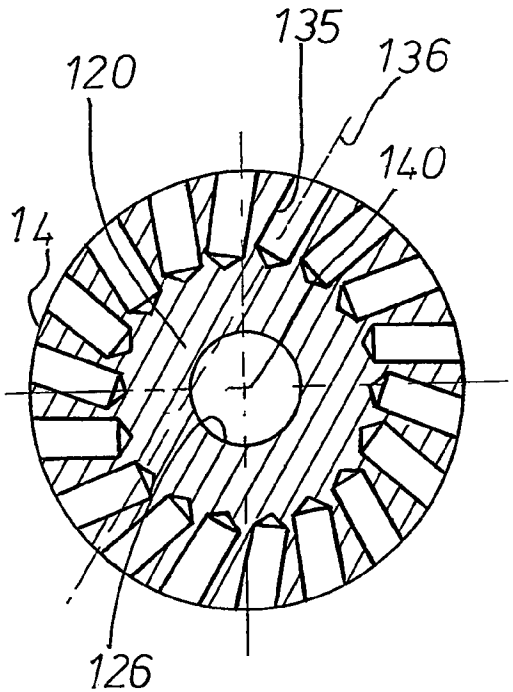
FIG. 19 is exclusively a cross-sectional view of another form of rotor where the radially drilled holes are partially inclined with respect to the center of the rotor.

FIG. 19 to 27 disclose a number of alternative hole configuration for the rows of openings in the rotor 120 that can be used in place of openings 132 in FIG. 17. In FIG. 19, openings in the form of bottom-ended holes 135 are inclined along axis denoted as 136 with respect to the center of the rotor 120 denoted as numeral 140. In FIG. 20, the inclination angle of the bottom-ended holes 142 along axis denoted as 143 is increased still further with respect to the center of the rotor 140. The direction of rotor rotation is preferably counter-clockwise but for certain operational conditions, the rotational direction of the rotors 120 may be reversed. However depending on operating conditions, the ability to sweep back the openings can enhance the tendency for cavitation to occur, although not strictly analogous, swept wings in supersonic aircraft are a significant advantage during high speed flight. FIG. 21 is depicts a series of bottom-ended holes 144 with a degree of bellmouthing 145 adjacent to the exterior surface 14 of the rotor 120. The relative diameter of the bellmouth at the rotor exterior surface 14 exceeding the diameter closer to the axis of rotation of the rotor. The effect of bellmouthing increases the available surface area on the exterior of the rotor where cavitation of the fluid occurs without necessarily increasing the number of drilled holes.

Figure 22:
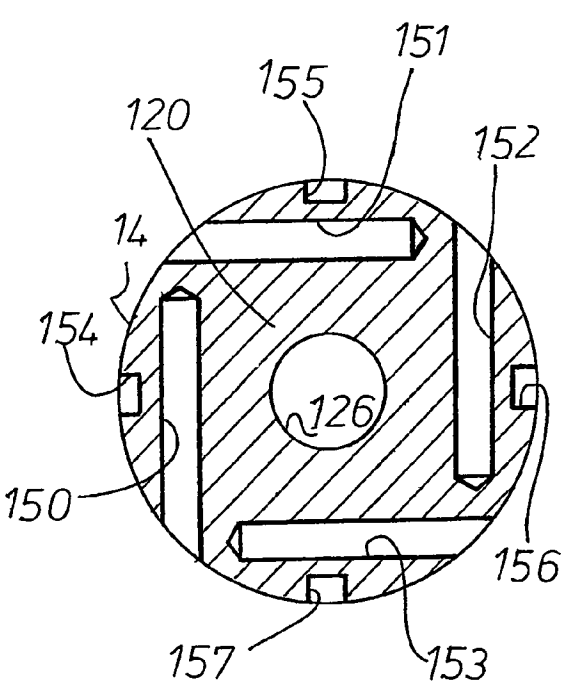
FIG. 22 is exclusively a cross-sectional view of another form of rotor depicting a first row of four deeply drilled holes in a rotor and where each hole is arranged perpendicular to adjacently positioned deeply drilled holes.
Figure 23:
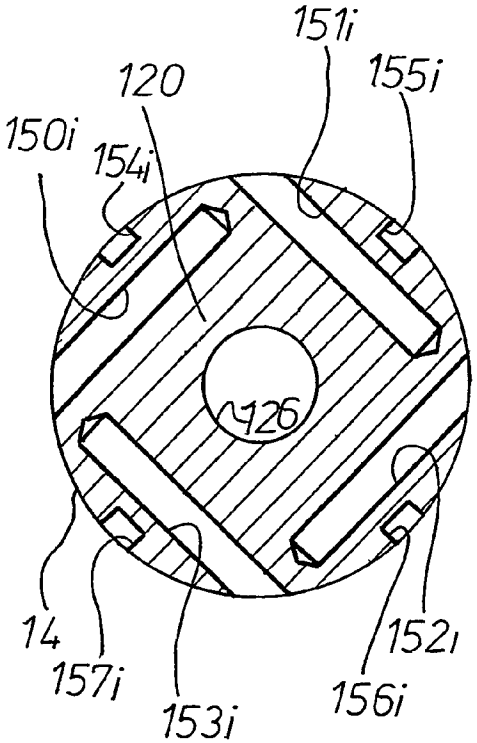
FIG. 23 is exclusively a cross-sectional view of another form of rotor depicting a second row of four deeply drilled holes in a rotor and where each hole is arranged perpendicular to adjacently positioned deeply drilled holes.
Figure 24:
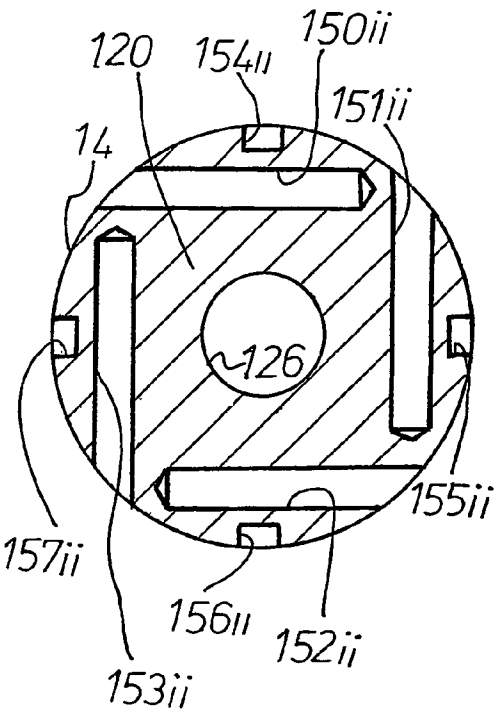
FIG. 24 is exclusively a cross-sectional view of another form of rotor depicting a third adjacent row of four deeply drilled holes in a rotor residing adjacent said second row of FIG. 23.

With respect to FIGS. 22 to 24, the modified rotor depicted as 120 is an example of a more economic rotor configuration. This may be achieved specifically by reducing the amount of machining time required to form all the various surface detail on the rotor. As such, whereas earlier rotor embodiments for illustration purposes only were deployed with eighteen holes per row for each rotor, in this modified form of rotor, only four deep drilled holes are required per row, shown as holes 150-153 in FIG. 10. The depth of such holes may then exceed in distance to a greater dimension than the raduis dimension of the rotor. Preferably four further openings, these being shallow pockets 154-157 are also present spaced at forty-five degrees to one another and approximately equi-spaced between each of the deeper holes 150-153. The next adjacent row of openings in shown in FIG. 23, and here deep holes are denoted as **150*i*-153*i*, and shallow pockets 154*i*-157*i*. Similarly, The next adjacent row of openings in shown in FIG. 24, and here deep holes are denoted as 150*ii*-153*ii* and shallow pockets as 154*ii*-157*ii***.

Figure 25:
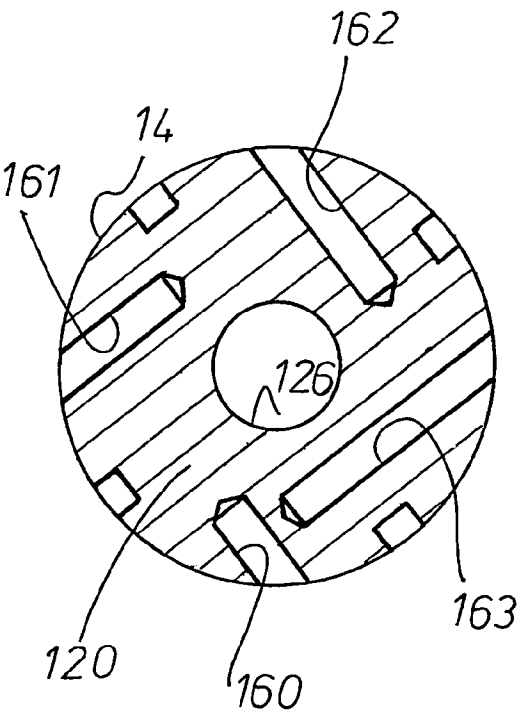
FIG. 25 is exclusively a cross-sectional view of a still further modified rotor to illustrate that such deeply drilled holes in any or all rows may have variable depth.

Note that all holes and shallow pockets in the second row of holes displayed in FIG. 23 are indexed by forty-five degrees with respect to first and third rows of holes and shallow pockets. There may be further or fewer rows of holes if so desired in the configuration chosen for the rotor, this ultimately depending on the given application for the device and this flexibility is of course equally applicable to other embodiments of the present invention, as is the intercommunication with internal passageways and internal fluid throttling devices in the rotor. FIG. 25 depicts a further possibility for the openings in the rotor 120, in-particular whereby the depth of holes deployed in any typical row of holes can be of increasing depth as is here shown for holes 160-163. Just as a vibrating tuning fork held over over a glass cylinder can cause the column of air inside the cylinder to resonate at the same frequency when the depth of the cylinder is of the appropriate length, the holes of varying depth in this rotor may more readily have the right combination of frequency, wave form and amplitude to cause a further excitation of the water molecules during the general disturbance experienced during cavitation.

Figure 27:
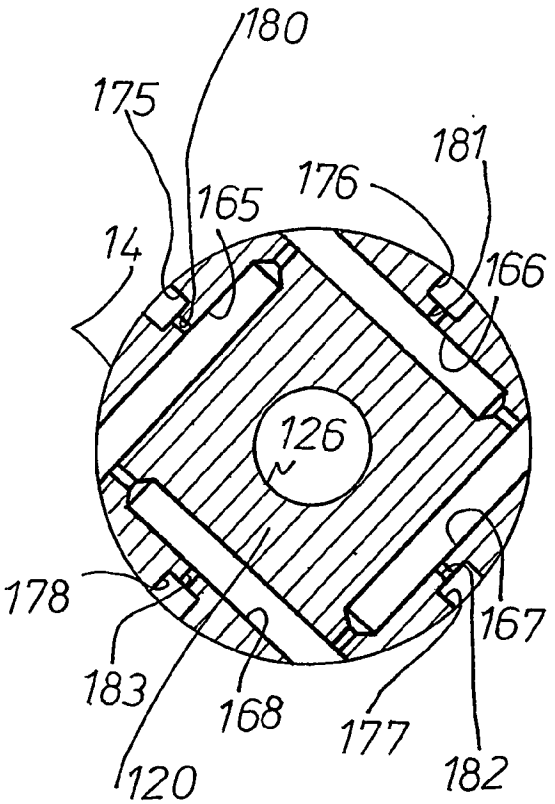
FIG. 27 is exclusively a cross-sectional view of a still further modified rotor to illustrate that such deeply drilled holes may be interconnected with an additional set of relatively shallow depth holes.
Figure 26:
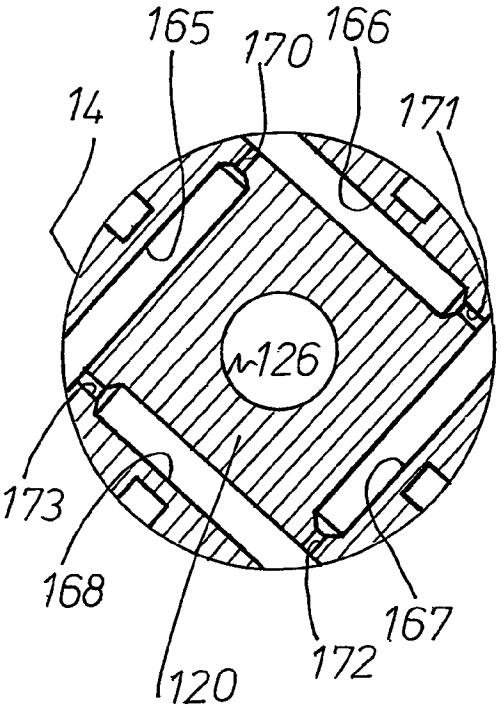
FIG. 26 is exclusively a cross-sectional view of a still further modified rotor to illustrate that such deeply drilled holes may be interconnected.

FIGS. 26 & 27 depict further modifications in the holes for rotor unit 120, and in particular to exemplify that any set of holes in any particular row of holes may be partially or fully interconnected to form a continuous pathways for the transmission of shock waves, and thereby heighten the effect from shock waves during the operation of the device. By way of example, FIG. 26 depicts rotor 120 having deep holes 165-168 which are interconnected by interconnecting passages 170-173. Although as shown, such passages 170-173 are of reasonable size to ease the machining operation, they may also be sized much smaller so that they act as throttles to limit the amount of fluid able to transit from, for example, hole 166 to 165 or vice versa. FIG. 27 is the rotor of FIG. 26 with the addition of shallow pockets 175-178, and where pockets 175-178 are provided with interconnecting passages, here shown as interconnecting passages 180-183.

Figure 29:
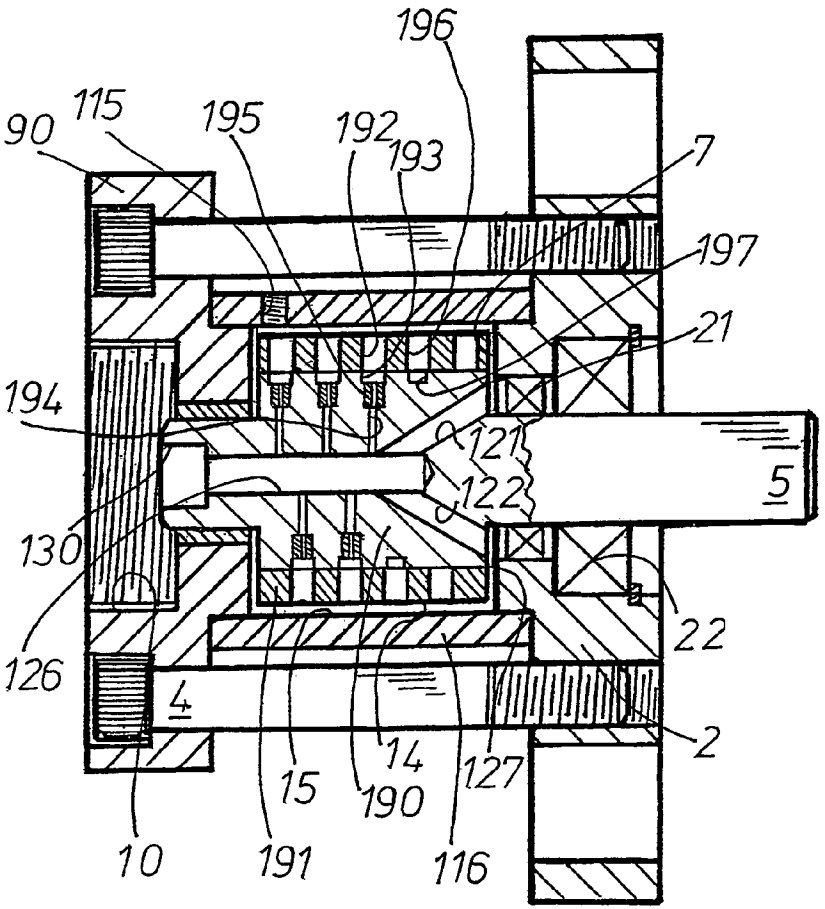
FIG. 29 is a longitudinal sectional view of the heat generating device of FIG. 28 having additional internal fluid throttling conduits.
Figure 28:
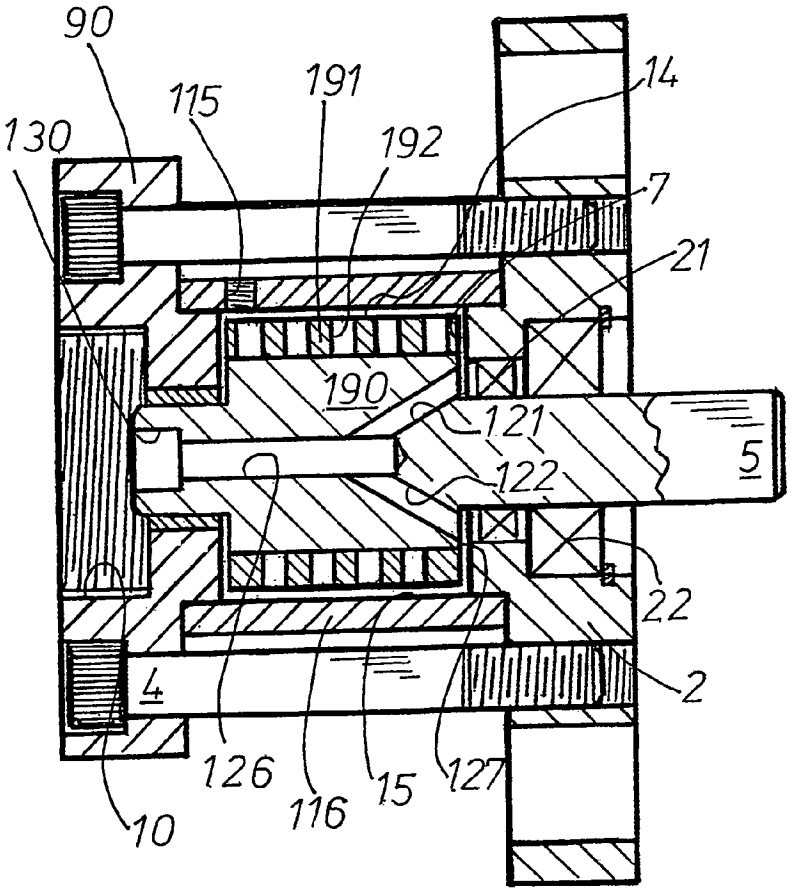
FIG. 28 is a longitudinal sectional view of the heat generating device of FIG. 17 having a modified rotor comprising two elements.

As compared to FIG. 17, in FIG. 28, the rotor unit is comprises of a central portion 190 integral with protruding drive shaft 5 and a surrounding sleeve portion 191 which is preferably a heat shrink fit on central portion 190. The sleeve portion is formed with several rows of openings such as opening denoted by reference numeral 192. In FIG. 29, the central portion 190 is modified, and opening 192 is shown fluidly linked to longitudinal passageway 126 via, firstly circumferential groove 193; secondly throttle 195; and thirdly connecting radial hole 194. The row of openings marked 196 are interconnected by a circumferential groove 197 and not directly linked to longitudinal passageway 126.

DETAILED DESCRIPTION OF THE THIRD EMBODIMENT OF THE INVENTION

Figure 31:
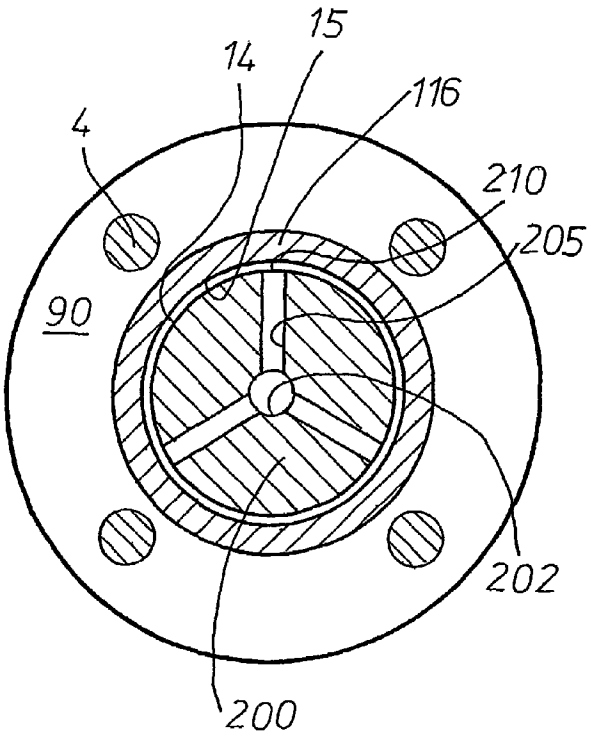
FIG. 31 is a transverse sectional view of the device taken at section VII-VII in FIG. 30.
Figure 30:
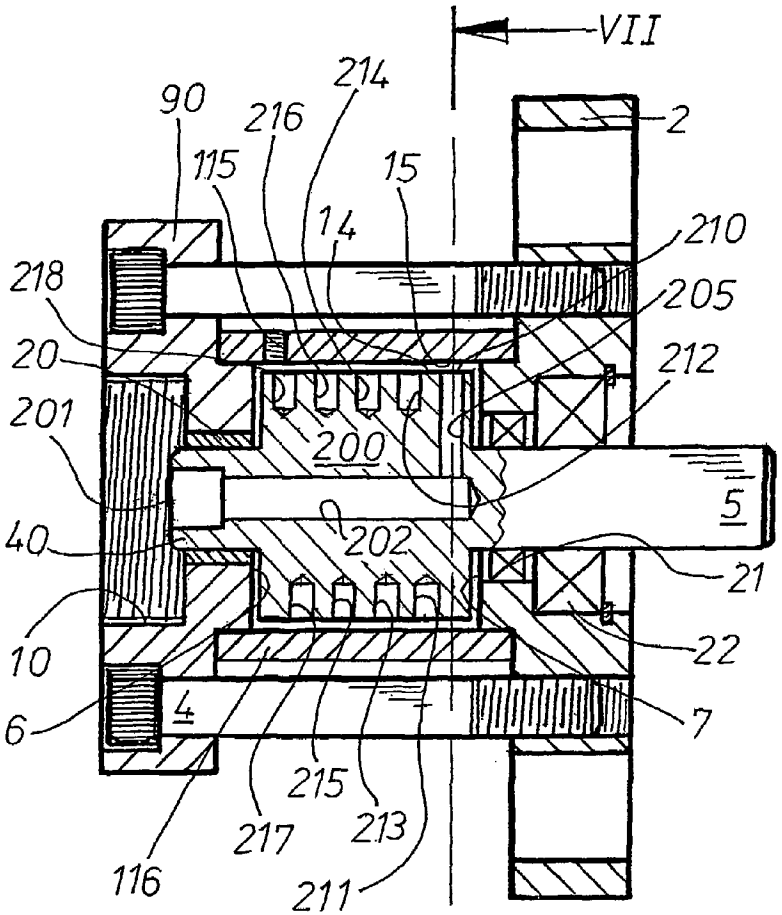
FIG. 30 is a longitudinal sectional view of the heat generating device of FIG. 1, according to a third embodiment of the present invention.

Whereas the last embodiment had the fluid arriving at the end of the rotor closest to the seal, for the third embodiment depicted in FIGS. 30 & 31, the fluid is arranged to arrive directly into the annular working clearance between rotor and surrounding housing. Rotatable component 200 is provided with an entrance port 201 leading to internal longitudinal passageway 202. Passageway 202 connects with one or more radial passageways 205 which direct the fluid, entering at intake 10, to the exterior peripheral surface 14 that lies radially inwards of bore 15. Once fluid entering this annular clearance at the point where the radial passageways 205 opens at 210 on peripheral surface 14, the fluid travels across a series of rows of holes denoted by reference numerals 211-218 before exiting the device in a heated condition at threaded exit connection 115. The relatively cold fluid entering at axial port 201 picks up heat from the rotating component 200 during its transit to opening 210 on peripheral surface 14, thereby pre-heating the fluid.

Figure 32:
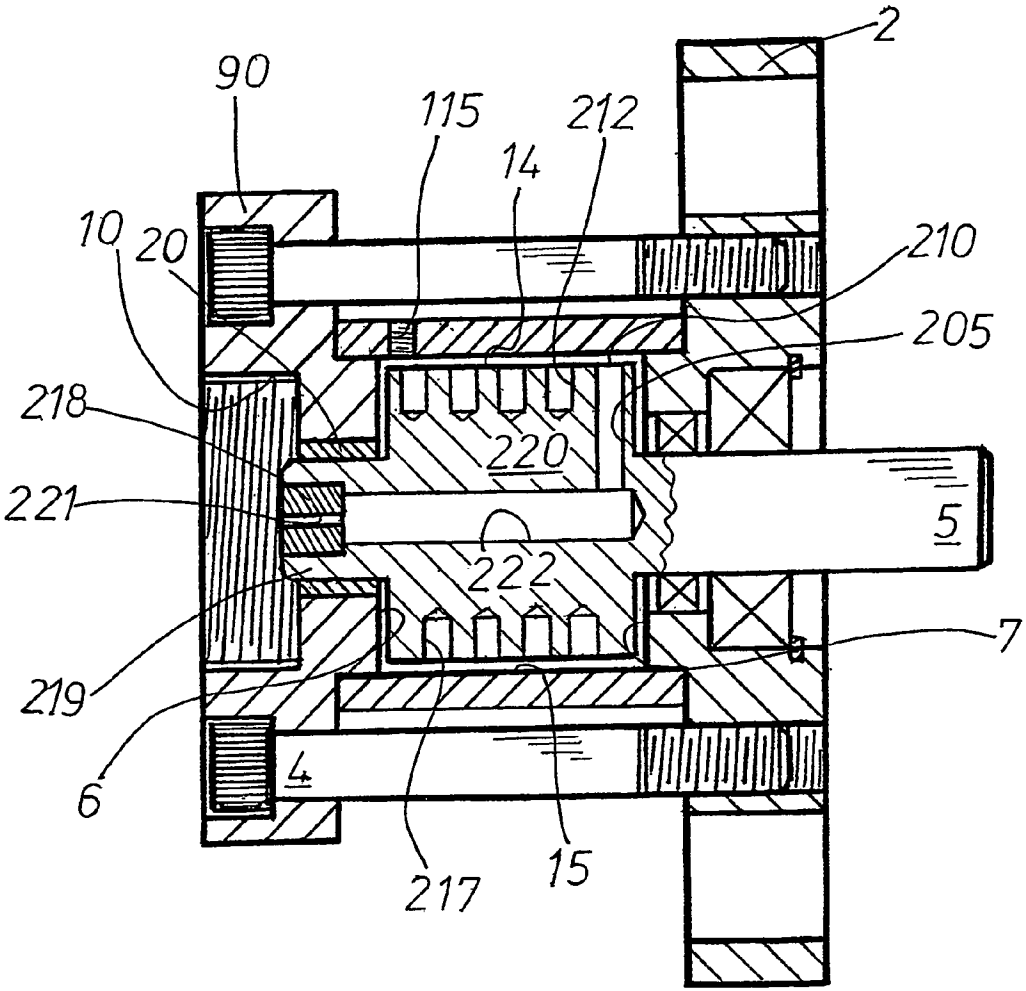
FIG. 32 is the heat generating device of FIG. 30 with a modified form rotor incorporating a series of openings fluidly linked to a single fluid throttling conduit.
Figure 34:
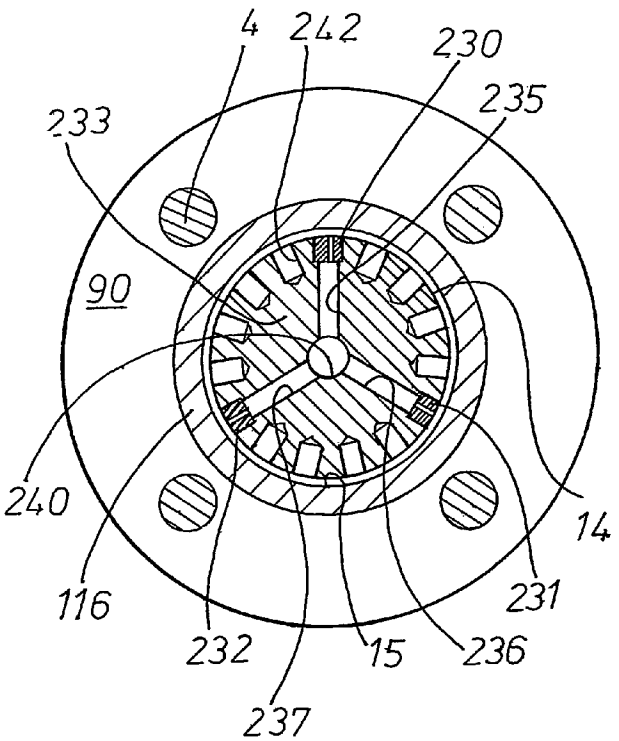
FIG. 34 is a transverse sectional view of the device taken at section VIII-VIII in FIG. 34.
Figure 33:
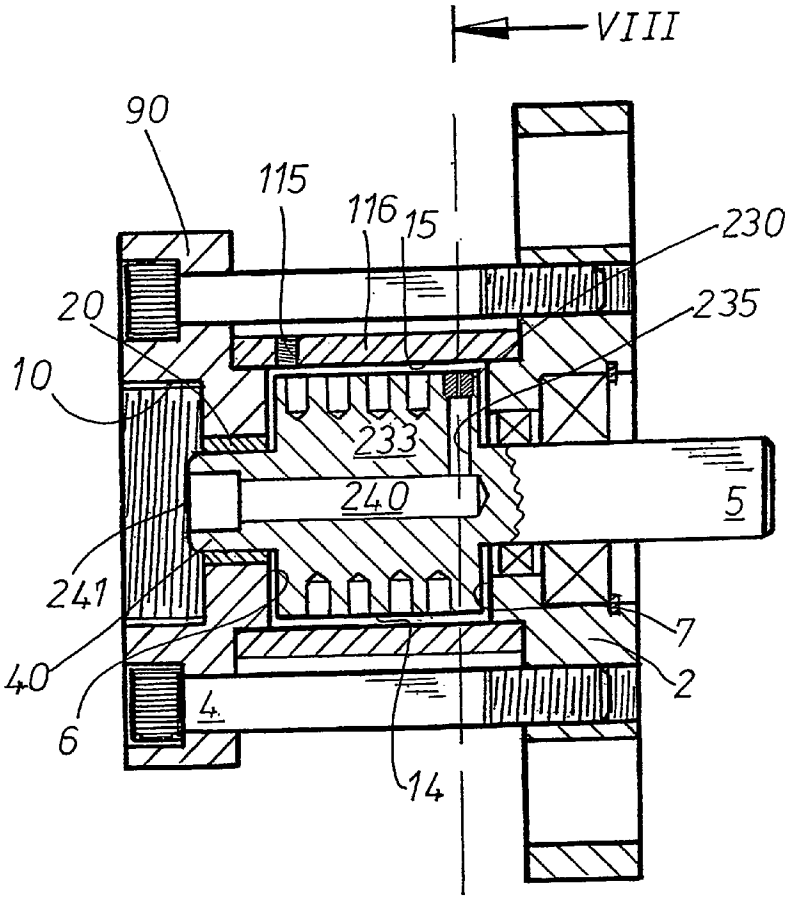
FIG. 33 is the heat generating device of FIG. 30 with a modified form of rotor.
Figure 36:
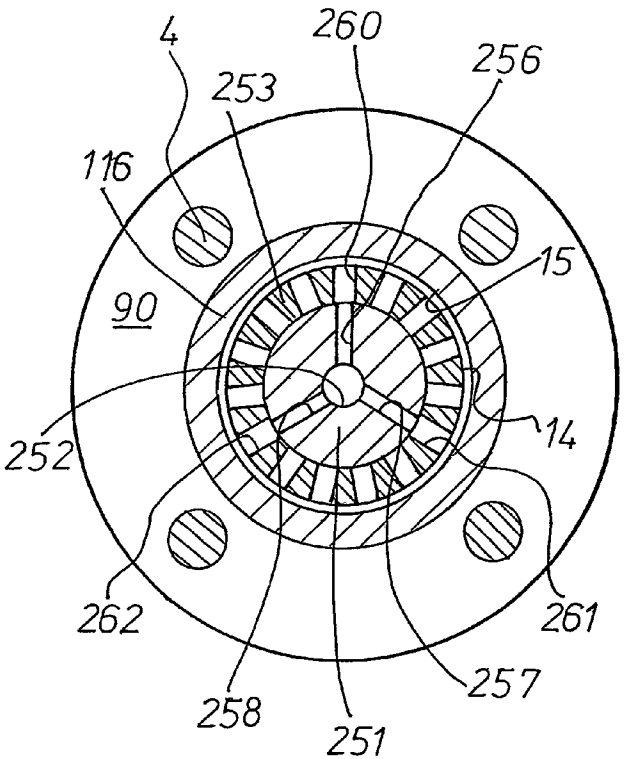
FIG. 36 is a transverse sectional view of the device taken at section IX-IX in FIG. 35.
Figure 35:
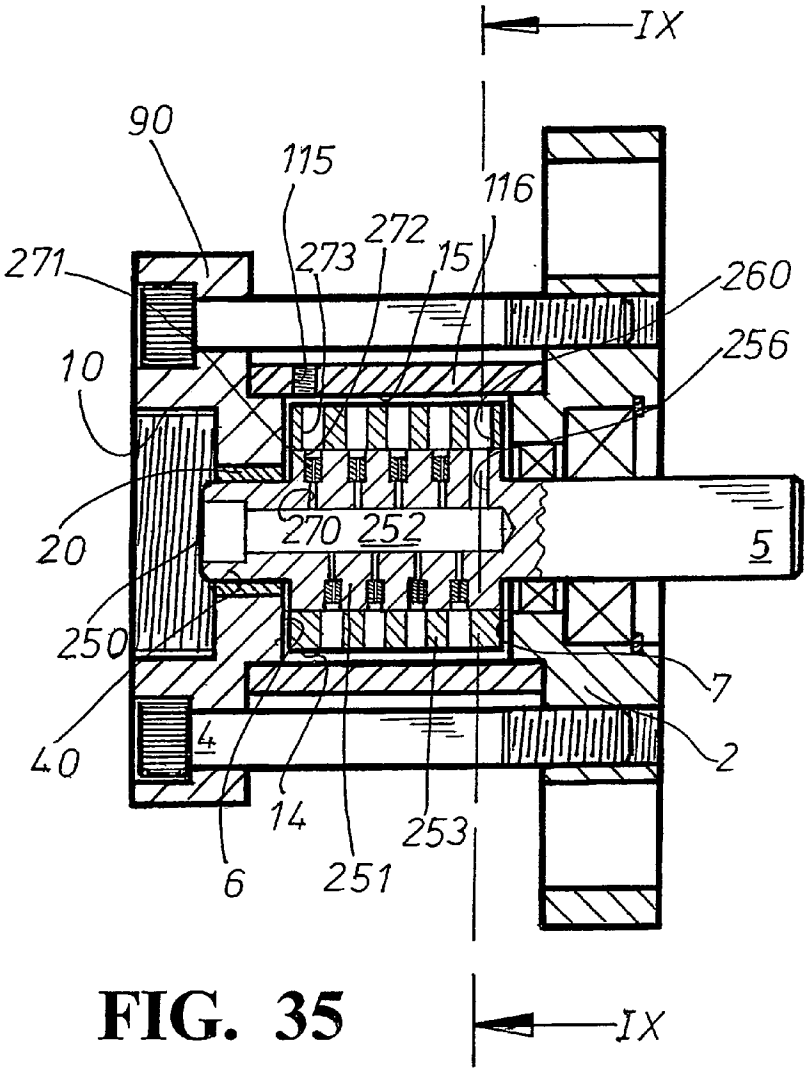
FIG. 35 is the heat generating device of FIG. 30 with a modified form of rotor.

As compared to FIGS. 30 & 31, the device of FIG. 32 incorporates a fluid throttle 218 at the inner shaft end 219 of rotating unit 220, the throttle having a central hole 221 to control the flow passing from inlet 10 to longitudinal passageway 222. Fine tuning the flow of fluid through the device may be achieved by placing a variable flow control valve (not shown) external of the unit and "upstream" of the exit 115 to ensure that the annular working clearance remains sufficiently filled with fluid. FIGS. 33 & 34 shows the positioning of three throttles 230, 231, 232 in the rotatable unit 233 in respective radial passageways 235, 236, 237. Radial passageways 235-237 connect with longitudinal passageway 240 which is in turn is connected by port 241 to inlet 10. Located on the circumference on the rotor between these throttle are a first array of openings 242. In the device shown as FIGS. 35 & 36, fluid entering the device at inlet 10 passes from entrance port 250 provided in the central portion 251 of the rotatable unit to reach the internal longitudinal passageway 252. The rotatable unit comprises a rotor sleeve portion 253 fixed to the central portion 251, preferably by a heat shrink fit, and where the protruding drive shaft 5 is formed integral with central portion 251. The primary flow pathway from longitudinal passageway 252 is via the three radial passageways 256, 257. 258 and their associated passages provided in central portion 251 denoted as passages 260, 261, 262, best seen in FIG. 36, before reaching the annular working chamber. There are also provided a series of secondary flow pathways in the central portion 251, and only the one nearest to exit 115 is described as the others are identical. The secondary pathway here comprises a radial hole 270 and throttle 271 located in central portion 251, and a circumferential groove 272 connects the fluid entering the groove 272 via the throttle 271 to all the openings 273 in this particular last row of openings. The throttles provide a flow restriction in each the secondary flow pathway to ensure that only a metered amount of fluid is admitted into the respective row of openings.

Where used, the addition of a plurality of fluid throttling conduits is useful, at least for the purpose of priming the unit prior to starting. So long as the orifice size is suitably small in the throttle, dimensioned as a generally narrow hole, the steady amount of fluid continuously entering the working annular passage via such throttle(s) holes will be relatively small as compared to the primary flow path entering the annular passage. With a suitable size of orifice for the intended application, the vacuum conditions formed near to the surface of the rotor in the region of the openings are not compromised. Although as shown, the orifice size of hole in the throttle conduit is relatively small-bore drillings can serve for certain applications when a higher flow rate into the interior of the rotor can be tolerated. Although round holes have been described as the preferred cross-sectional shape for the orifice in a fluid throttling conduit, this term is intended to cover other shapes such as for example, throttle grooves.

As used herein, the term "fluid heating" contemplates the heating of either liquids or gases, although in practice the heating of liquids will be more commonly performed. In the context of heating liquids, it will be expressly understood that the heating device and method according to the invention include not only the generation of a hotter liquid, but also the phase transformation of the liquid into a gas. Therefore, the heat generating device and method as described are also steam generators, wherein the difference between raising the temperature of a liquid versus generating a vapor phase of the liquid may be controlled by the speed of the rotation of the rotor and the design of the cavitation-inducing surface irregularities.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

The invention claimed is:

1. A fluid heating device comprising a housing having an internal chamber and a fluid inlet and a fluid outlet in fluid communication with said chamber; a rotor disposed centrally in said chamber and mounted for rotation within said chamber about an axis of rotation, said rotor in spaced relation to said housing to provide a generally annular passage for fluid to travel from said inlet towards said outlet, said rotor having a plurality of interior passageways formed therein and a plurality of openings formed on an exterior surface thereof confronting fluid in said passage and disposed in a plurality of circumferential rows spaced about said rotor along the longitudinal axis of said rotor, wherein said exterior surface of said rotor terminates at first and second planar end faces on said rotor, and wherein one of said plurality of interior passageways is a longitudinal passageway extending along said axis of rotation for a distance greater than the distance between said first and second planar end faces, wherein rotation of said rotor causes said plurality of openings to impart heat-generating cavitation to a fluid entering said chamber.

2. The device according to claim 1 wherein said openings are disposed radially outwardly of said interior passageways and at least a proportion of said interior passageways and at least a proportion of said plurality of openings are in fluid communication.

3. The device according to claim 1, and further comprising at least one fluid throttling conduit disposed in at least one of said interior passageways.

4. The device according to claim 1, and further comprising at least one fluid throttling conduit disposed in said rotor and in fluid communication with at least one of said plurality of openings.

5. The device according to claim 1 wherein said interior passageways provide a heat transmitting surface to pre-heat at least a proportion of said fluid entering said passage.

6. The device according to claim 1 wherein said interior passageways form an interior vessel for the storage of fluid, said openings disposed radially outwardly of said interior vessel and at least a proportion of said plurality of openings communicating with said vessel, said vessel at least partially evacuated of fluid during rotation of said rotor.

7. The device according to claim 6 wherein the evacuated fluid passes through at least certain ones of said openings into said passage.

8. The device according to claim 1 wherein said housing further comprises at least one fluid port, said fluid port being disposed between said inlet and the first planar end face on said rotor.

9. The device according to claim 7, and further comprising a fluid seal disposed in said housing and surrounding said drive shaft, said seal and said inlet disposed on opposite axial sides of said housing.

10. The device according to claim 9, and further comprising means to cool said seal.

11. The device according to claim 1 wherein said rotor further comprises a fluid entrance port disposed axially adjacent said inlet, said entrance port communicating with said longitudinal passageway.

12. The device of claim 1, and further comprising a plurality of annular fluid distribution grooves in said rotor, wherein a groove interconnects all openings in a respective circumferential row.

13. The device of claim 1, and further comprising a plurality of annular fluid distribution grooves in said rotor, wherein a groove connects all openings in a respective circumferential row to said interior passageway.

14. The device according to claim 1 further comprising a plug disposed in said longitudinal passageway, wherein said interior passageways form an interior vessel for the storage of fluid, said openings disposed radially outwardly of said interior vessel, said vessel at least partially evacuated of fluid during rotation of said rotor.

15. The device according to claim 14 wherein at least a proportion of said plurality of openings is in fluid communication with said vessel.

16. The device according to claim 14 wherein said plug is disposed axially adjacent said inlet.

17. The device according to claim 14, further comprising a throttle hole disposed in said plug.

18. The device according to claim 1 wherein said rotor further comprises a fluid entrance port disposed axially adjacent said inlet, said entrance port communicating with said longitudinal passageway and said fluid entrance port being disposed radially closer to said axis of rotation than said fluid outlet.

19. The device according to claim 1 wherein some of said openings are formed as radial holes, the depth of which exceeding in distance to a greater dimension than the radius dimension of said rotor and where said radial holes interconnect with each other internally of said rotor to form a continuous pathway for the transmission of shock waves.

20. The device according to claim 1 wherein at least one row of said openings are fluidly interconnected by an annular groove disposed in the interior of said rotor, and further comprising at least one fluid throttling conduit disposed radially inwardly of said annular groove to be nearer said axis of rotation than said openings.

21. The device according to claim 1, and further comprising means to prime said chamber with priming fluid.

22. The device according to claim 1 wherein said longitudinal passageway is disposed coincident with said axis of rotation.

23. The device according to claim 1 wherein said housing includes a rear housing member and wherein said fluid inlet is disposed in said rear housing element in a location radially closer to said axis of rotation than said fluid outlet; and further comprising a partitioning wall in said rear housing member and separating said fluid inlet from said internal chamber, at least one port formed in said partitioning wall and fluidly linking said inlet to said internal chamber.

24. The device according to claim 1 wherein another of said plurality of interior passageways is a radial passageway, said radial passageway being disposed closer to the second planar end face than to said first planar end face of said rotor, and said radial passageway being in fluid communication with said longitudinal passageway and terminating on said exterior surface of said rotor.

25. The device according to claim 24, further comprising a fluid throttle disposed in said radial passageway.

26. The device according to claim 1 wherein another of said plurality of interior passageways is an inclined passageway, said inclined passageway being disposed closer to the second planar end face than to said first planar end face of said rotor, and said inclined passageway being in fluid communication with said longitudinal passageway at a lesser radial distance from said axis of rotation and terminating at the second planar end face of said rotor at a greater radial distance from said axis of rotation.

* * * * *